US010076697B1

(12) United States Patent
Publicover et al.

(10) Patent No.: US 10,076,697 B1
(45) Date of Patent: Sep. 18, 2018

(54) IMPACT SAFETY PAD FOR TRAMPOLINE

(71) Applicant: Mark W. Publicover, Saratoga, CA (US)

(72) Inventors: Mark W. Publicover, Saratoga, CA (US); Jon P. Hylbert, Los Gatos, CA (US); Kevin B. Charles, Millbrae, CA (US)

(73) Assignee: Mark W. Publicover, Saratoga, CA (US)

( * ) Notice: Subject to any disclaimer, the term of this patent is extended or adjusted under 35 U.S.C. 154(b) by 0 days.

(21) Appl. No.: 15/179,953

(22) Filed: Jun. 10, 2016

Related U.S. Application Data

(63) Continuation of application No. 15/050,458, filed on Feb. 22, 2016, which is a continuation-in-part of (Continued)

(51) Int. Cl.
*A63B 5/11* (2006.01)
*A63B 71/00* (2006.01)

(52) U.S. Cl.
CPC ..... *A63B 71/0054* (2013.01); *A63B 5/11* (2013.01); *A63B 2071/0063* (2013.01)

(58) Field of Classification Search
CPC .... A63B 5/11; A63B 5/16; A63B 6/00; A63B 21/00058; A63B 21/00061; A63B 21/00065; A63B 21/00069; A63B 21/008; A63B 21/0083; A63B 21/0085; A63B 21/0087; A63B 21/02; A63B 21/028; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0555; A63B 21/0557; A63B 21/068; A63B 21/1672; A63B 21/4023; A63B 21/4037; A63B 21/4041; A63B 21/4045; A63B 21/4047; A63B 21/4049; A63B 71/0054; A63B 2071/0063; A63B 2071/0072; A63B 2244/102;
(Continued)

(56) References Cited

U.S. PATENT DOCUMENTS 3,782,724 A * 1/1974 Rottman ..... A63B 63/008 267/140
3,831,941 A * 8/1974 Pease ..... A63B 71/0054 267/116

(Continued)

*Primary Examiner* — Andrew S Lo
*Assistant Examiner* — Gary D Urbiel Goldner
(74) *Attorney, Agent, or Firm* — Klarquist Sparkman, LLP

(57) ABSTRACT

A trampoline has a safety bag that prevents a user from damaging a pole to which the safety bag is attached, or to a safety system comprising an enclosure wall or net for the trampoline; and a safety device where the weight may be distributed. The safety bag is multi-adjustable for density, firmness, and weight at different contact locations on the safety bag through internal adaptations, and the safety bag is additionally able to absorb contact and impact force in a manner that disperses and distributes impact energy in a manner protecting the user from unwanted contact or injury with the trampoline, and to reduce unwanted movement of the trampoline to weakened ground contact.

26 Claims, 19 Drawing Sheets

Related U.S. Application Data application No. 14/843,752, filed on Sep. 2, 2015, which is a continuation of application No. 14/664,802, filed on Mar. 20, 2015.

(60) Provisional application No. 61/968,339, filed on Mar. 20, 2014.

(58) Field of Classification Search

CPC ..... A63B 2244/104; A63B 2244/106; A63B 2244/108; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345

See application file for complete search history.

(56) References Cited

U.S. PATENT DOCUMENTS 3,958,801 A * 5/1976 Correa ..... A63B 3/00 473/441
4,198,036 A * 4/1980 O'Neal ..... B61B 12/06 267/140
4,477,083 A 10/1984 Sowards
4,596,106 A * 6/1986 Kunczynski ..... A63B 71/0054 267/116
5,182,824 A * 2/1993 Cipriano ..... A47C 17/52 5/181
5,524,882 A * 6/1996 Wagner ..... A63B 71/0054 267/140
5,607,377 A * 3/1997 Wilkinson ..... A63B 5/11 482/27
5,611,760 A * 3/1997 Jordan ..... A63C 19/005 482/83
5,674,157 A 10/1997 Wilkinson
5,941,798 A 8/1999 Coan
D433,725 S 11/2000 Chen
6,261,207 B1 7/2001 Publicover et al.
6,336,893 B1 1/2002 Chen
6,340,334 B1 * 1/2002 Olsen ..... A63C 19/005 472/92
D462,103 S 8/2002 Chen
D478,955 S 8/2003 Chen
6,607,468 B1 * 8/2003 Nichols, Jr. ..... A63B 5/11 482/27
6,679,811 B2 1/2004 Chen
6,846,271 B2 1/2005 Publicover
7,060,001 B2 6/2006 Publicover
7,150,690 B1 * 12/2006 Cusick ..... A63B 63/004 267/116
7,666,109 B2 * 2/2010 White ..... A63B 71/0054 473/478
7,758,471 B2 7/2010 Nelson
7,833,132 B2 11/2010 Publicover et al.
8,100,813 B2 1/2012 Publicover
8,221,294 B2 7/2012 Publicover
8,286,280 B1 * 10/2012 Matos ..... A47C 17/86 5/2.1
8,430,795 B2 4/2013 Publicover et al.
8,657,696 B1 * 2/2014 Gurley ..... A63B 5/11 472/92
8,936,533 B2 1/2015 Publicover et al.
9,227,127 B2 * 1/2016 Vince ..... A63B 69/004
9,289,637 B2 3/2016 Publicover et al.
9,339,676 B2 5/2016 Publicover et al.
2002/0137598 A1 * 9/2002 Publicover ..... A63B 5/11 482/27
2004/0121883 A1 * 6/2004 Publicover ..... A63B 5/11 482/29
2005/0209053 A1 * 9/2005 Knox ..... A63B 5/11 482/27
2008/0188360 A1 * 8/2008 Chu ..... A63B 69/004 482/83
2008/0269021 A1 * 10/2008 Publicover ..... A63B 5/11 482/29
2009/0305825 A1 * 12/2009 Gamboa ..... A63B 69/00 473/438
2010/0311545 A1 * 12/2010 Fenn ..... A47C 9/022 482/29
2011/0287899 A1 * 11/2011 West ..... A63B 5/11 482/27
2013/0017895 A1 * 1/2013 Mechling ..... A41D 13/0543 472/93
2013/0196823 A1 * 8/2013 DeBlanco ..... A63B 5/11 482/27
2014/0228176 A1 * 8/2014 Miller ..... A63B 5/11 482/27
2014/0230154 A1 * 8/2014 Palumbo ..... A63B 6/02 5/706
2014/0243155 A1 8/2014 Publicover et al.
2014/0309082 A1 * 10/2014 Iglehart ..... A63B 69/32 482/9
2015/0335980 A1 * 11/2015 Gordillo Martinez ..... A63B 71/0054 267/140.11
2016/0279457 A1 * 9/2016 Adams ..... A63B 71/02
2017/0216648 A1 * 8/2017 Male ..... A63B 71/023 482/29

* cited by examiner

IMPACT SAFETY PAD FOR TRAMPOLINE

CROSS REFERENCE TO RELATED APPLICATIONS

This is a continuation of application Ser. No. 15/050,458, filed Feb. 22, 2016, which is a continuation-in-part of application Ser. No. 14/843,752, filed Sep. 2, 2015, which is a continuation of application Ser. No. 14/664,802, filed Mar. 20, 2015, which claims the benefit of U.S. Provisional Application No. 61/968,339, filed Mar. 20, 2014, all of which applications are incorporated herein by reference in their entirety.

BACKGROUND AND SUMMARY

Disclosed is a safety device that provides protection from impacts against a trampoline enclosure and its support members or poles; as well as reducing to some degree, the incidence of trampoline tipping or tip over. Also, disclosed are safety impact bags or pads that may be utilized with any trampoline capable of having an enclosure with support members or poles for that enclosure. Also disclosed is a safety pad that may be utilized with a trampoline capable of having a pole or other support member attached to the trampoline and extending above the jump surface. Also disclosed is a safety pad that may be employed between at least two poles or support members, with or without an enclosure which provides improved safety and impact absorption when a person impacts or otherwise contacts the safety pad. Disclosed is an impact safety pad that, upon impact, helps shift some of the impact force more downward than otherwise would occur, which helps prevent unwanted tipping of the trampoline, as well as increasing more weight and/or force inward toward a point of the trampoline within its perimeter. This effect increases the higher the impact point on the safety pad occurs above the trampoline surface. For the safety pad to be useful and to provide a minimal best protection to an impacting user, at least 50% of the volume of the bag needs to lie within the perimeter of the trampoline, or trampoline frame rail that supports the jump surface. This is because more of the pad volume of material needs to be in front of the enclosure pole such that it can absorb any impacts by a user without the user inadvertently striking the pole, and so the user has the minimum safe coverage for protection.

The above and other effects, features, and advantages of the present invention will become more apparent from the following detailed description taken in conjunction with the drawings.

DETAILED DESCRIPTION

Figure 1A:
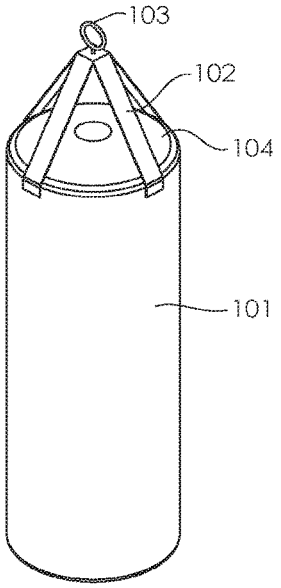
FIG. 1A is an isometric view of a sphere bladder filled impact safety bag.

Trampoline systems typically have a rebounding surface and a frame that suspends the rebounding surface above the ground. Such trampoline systems often also have a safety enclosure wall that comprises an expanse of flexible material that is coupled to the vertical support members and arranged to define a jumping chamber.

Described herein are trampoline systems that have a safety pad positioned such that at least 50% of the volume of the safety pad is located inwardly of the frame as viewed from the top. Such devices may function with, or without, a net or enclosure wall being employed. However, employment of a net wall maximizes the benefits of the design. Such trampolines are generally greater than 4-5 feet in diameter, and generally greater than 24 inches above the ground surface.

For the purposes of this disclosure, a "pole" is any support member that is attached to the trampoline and extends above the trampoline surface. The pole may be tubular in shape or as solid bar. The surface of the pole may be cylindrical, with the cross-section of the cylinder being a circle, being a regular or irregular polygon such as a square, octagon or the like that is suitable to perform the same function of supporting a net or wall encompassing the trampoline surface. The poles must be sufficiently rigid to be, along with any attached structural members, self-supporting and able to support the weight of the adjacent enclosure wall and any other attachments. The enclosure wall may be additionally supported by one or more rigid members that extend horizontally between the tops of the vertical support poles. It will generally be of a height at least equal to the total length of the attached safety pad and its coupling members. The height of the poles may vary, but are generally less than 8 feet above the rebounding surface of the trampoline. The flexural rigidity may vary, and as such, the weight of the safety pad will need to be lighter in weight to account for increasing flex of the vertical support members. The flimsiest or most flexible enclosure poles that are usable should be greater than 12,000 pounds-inch^2. The vertical bag length may vary, but should be at least two feet to the length of the pole itself so long as the pad can rotate or move to some degree in order to help redirect a user who impacts it.

The conditions within a trampoline jumping surface and enclosure are utterly unique compared to suspending a bag next to a wall or ground secured barrier. The activity on trampoline is fluid, three dimensional, where the bouncing of a user can send them in different directions upon each separate impact or jump.

Disclosed herein is multi-density adjustable safety bag or pad where the internal mass, weight, or density can be modified or changed to adapt to intended or unintended impact, and provide for increased safety of a trampoline user. The pad or bag (which are interchangeable terms for the purposes of this disclosure) may be of any three dimensional shape or polyhedral or non-polyhedral shapes, and the drawings are not intended to limit the shape or external proportions of the pad or bag. The bag may also be referred to as a "bladder" to descriptively identify the bag as capable of internal spaces or containers within that are held together within a bag like or pad container. Additionally, the smaller internal containers may also be referred to as bladders. The internal bladders may be of any shape that can be adapted to fill the safety pad. Depending upon the ratio of liquid versus air filled internals; other shapes will still alter and thus conform internally, e.g. FIG. 1B, 105.

Disclosed is a system that comprises a trampoline including a rebounding surface supported by a perimeter frame or rail. A support member, such as a tubular support member, is attached to the trampoline and extends to an elevation above the rebounding surface. A safety pad is attached to the support member, that is at least 2 feet in height, and that is at least 3 times wider than the support member; the safety pad being positioned such that at least 50 percent of the volume of the safety pad is located inwardly of the support member such that, upon impact by a user, the safety pad partially revolves around the support member and laterally redirects the user. The pad should be at least three times wider or three times bigger in diameter than the supporting pole to protect the user from impacting the pole when impacting the safety pad from the side or from the front. Diameters that are smaller than this allow an impacting body or body part of a user to more likely strike or contact the pole during more severe impacts. These are the same reasons why at least 50% of the volume of the pad should be positioned within the frame perimeter as viewed from above or from the top. Because it is more difficult to hit a pad while bouncing on a rebounding surface, the minimum safe height of the pad should be 2 feet to prevent missed impacts to that pad from landing directly on the support member. Through trial testing we have found that a minimum of 2 feet in height provides a minimum target size necessary to allow the vast majority of intended impacts to land on the pad. To assure that nearly all intended impacts land on the pad the, the pad would preferably be 3-5 feet in height. For the most protection, the pad is at least as tall as the portion of the support member above the jump surface.

Also disclosed is the previously described structure wherein a safety pad is positioned at a location between two support members, or poles. The safety pad is suspended from either a rigid horizontal member, or suspended from a non-rigid or flexible member like a taught strap, such that it prevents impact against the wall of the enclosure and may help to reduce overall tipping of the trampoline and enclosure structure. It should be apparent that when a non-rigid support member is utilized, the safety bag may descend to some degree such that the flexible bag supports that are supported by the vertical poles (directly or indirectly) can show a "V" form, where the member descends at an angle to the connection point(s) on the safety bag. Rigid members will maintain their horizontal orientation as they extend from upper pole area to upper pole area. Indirectly coupled poles simply anticipate that some trampoline enclosures may be configured such that the vertical support members or poles reside outside of the enclosure wall. In such cases, the safety pad may require an additional segment of material or an additional member to permit the pole to help support, at least in part, the weight of the bag, while still being able to hang fully within the enclosure wall.

Because it protects against net impacts and not impacts against a supporting tubular member or pole, the dimensions of the pad may be of a smaller diameter, but will still have at least 50% of its volume located inwardly of the frame rail of the trampoline, as viewed from above. Another way to describe this is to say that at least 50% of the volume of the pad is located within a region defined by a cylinder extending vertically from the frame rail of the trampoline.

Disclosed are spheres, and disks, that contain a gas or liquid, or both; but can include other shapes not shown in the drawings, which also perform the same function as those shown in the drawings, so long as these other shapes conform internally in a similar manner as that shown in the drawings.

The terms, pad, bladder or bag mean the same thing for purposes of this disclosure, and the terms are interchangeable to discuss the disclosed device. Disclosed is a safety pad that deflects a user from contact with any kind of support member or pole or other mechanism holding said bag. Such impacts or contacts may be intentional or unintentional on a user's part. The support member or pole may be located as part of, or adjacent to, a trampoline enclosure such that a user of the trampoline my contact the bag in some manner while on the trampoline. This pad device while serving primarily as a safety bag, additionally is and concurrently capable of receiving impacts from one or more users while on a trampoline.

The design of the safety bag has many benefits not currently available for trampoline use. The safety bag contains bladders which are replaceable in the event of damage, compression, or added to or reduced, to affect the performance characteristics of the bag in response to impacts. The bladders, or full bags, may be spheres, disks, or other three dimensional shapes or polyhedral or non-polyhedral spheres and shapes. The bladders may be filled with various mediums such as liquids of various viscosities, and gases, to alter the performance characteristics. The viscosity of the liquid contained or introduced into the bladders may vary from low viscosity like water for example, to liquids of higher viscosity, like silicone for example. The liquid may be composed of other substances such as solid fillers of various granularity or sizes, and can be harder or softer; and the gas filling can be of different types of gases, but typically air. By using different gases and liquids, the density, weight, and impact response can vary according to a desired result. Additionally, various densities of foams and the like may be utilized, such that a bladder may be "solid" in that it will not contain a liquid or gas, but instead is a compressible material that substantially returns to its original shape after impact.

Another way to vary these factors is to alter the form of the internal bladders. For example, bladders may be stacked within the safety bag such that the changes in impact response of the safety pad varies linearly top to bottom or bottom to top of the bag, FIG. 1C, FIG. 1E. Instead of a linear configuration, the internal bladders may be configured concentrically, like that of tree rings, FIG. 10C; or can be configured as longer linear tubes that are adjacent to each other, FIGS. 10E, 10F and 10H, 101. In each configuration, the density and composition of each bag may vary. Additionally, the impact response characteristics vary. For example, a longer linear oriented tube bladder 10E will result in consistent impact response along the entire length, as that bladder, whereas an impact to an adjacent bladder can be made to vary the response by altering the adjacent bladders internal composition. In another example, a concentric internal bladder system 10C will not be affected by different impact locations adjacent to a first impact location. But, by varying the internal composition of the concentric rings, the total impact response can be altered but consistent along all impact locations. Thus, an inner ring bladder may be firm, one filled only with air, and another bladder formed of a solid such as foam.

Figure 10A:
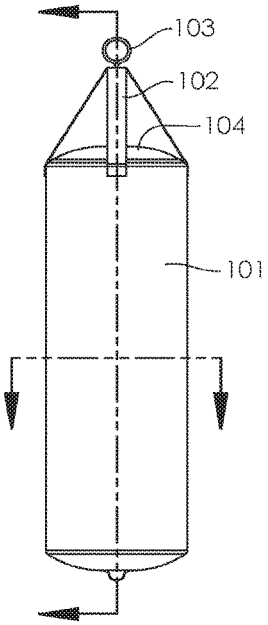
FIG. 10A is a front view of a concentric bladder impact safety bag. 20
Figure 10B:
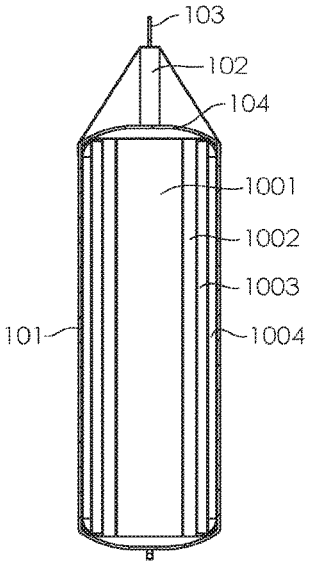
FIG. 10B is a side cross section view of a concentric bladder impact safety bag.
Figure 10C:
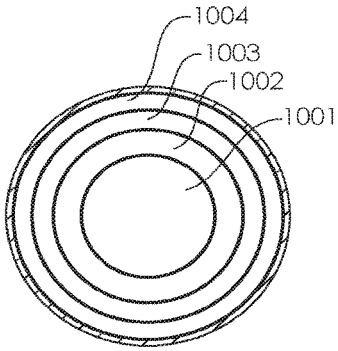
FIG. 10C is a top cross section view of a concentric bladder impact safety bag.
Figure 10D:
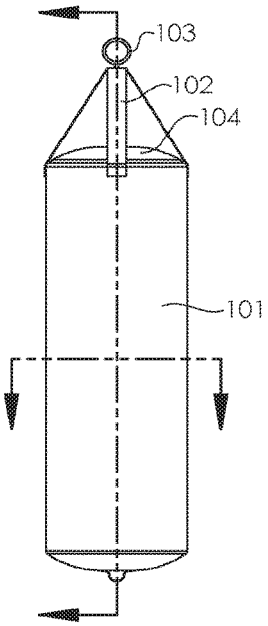
FIG. 10D is a front view of an internally sectioned impact safety bag.
Figure 10E:
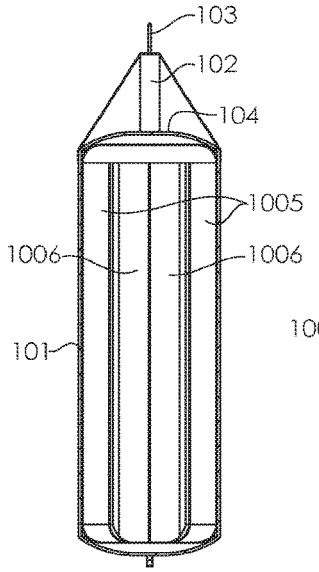
FIG. 10E is a side cross section view of an internally sectioned impact safety bag.
Figure 10F:
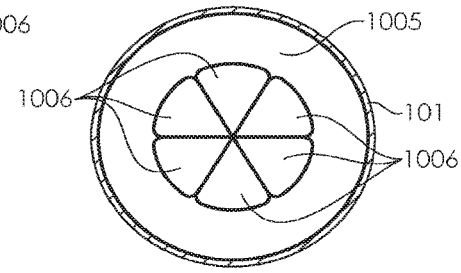
FIG. 10F is a top cross section view of an internally sectioned impact safety bag.
Figure 10G:
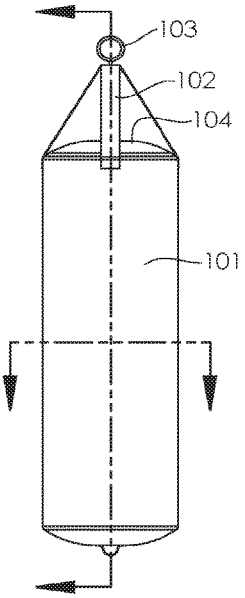
FIG. 10G is a front view of a tube chambered impact safety bag.
Figure 10H:
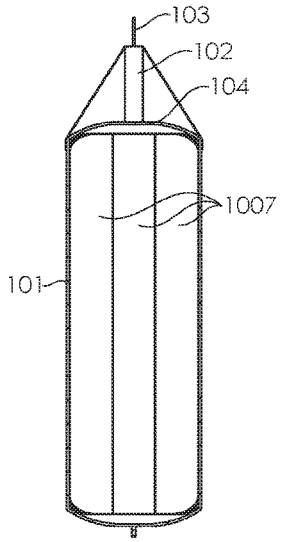
FIG. 10H is a side cross section view of a tube chambered impact safety bag.
Figure 10I:
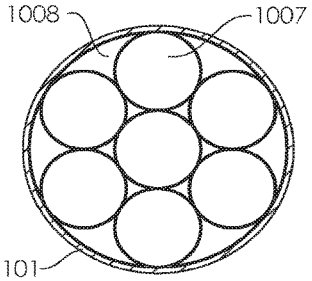
FIG. 10I is a top cross section view of a tube chambered impact safety bag.
Figure 10J:
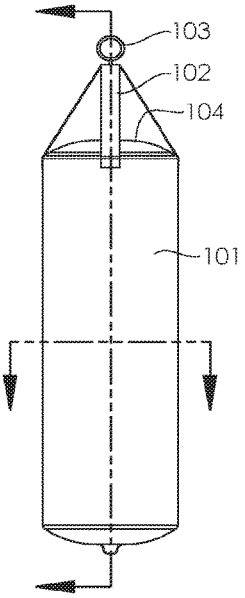
FIG. 10J is a front view of a sphere filled impact safety bag.
Figure 10K:
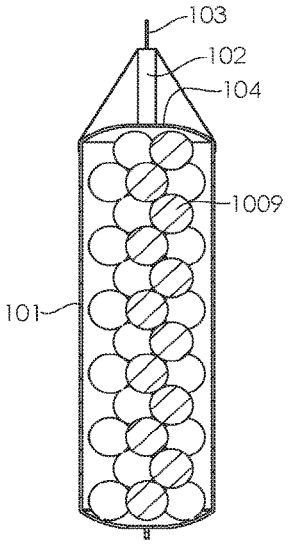
FIG. 10K is a side cross section view of a sphere bladder filled impact safety bag.

In another example, simple spheres, FIG. 10K, (or other three dimensional shapes) may be utilized to provide even more internal variations and bladder configurations (gas, liquid or both) to substantially vary the impact response of the safety pad at every different potential impact location on the safety pad by a user. If a user wanted to throw strikes or punches, such adaptability as previously described, will allow a different impact response from a kick down low on the pad, versus that of a hand strike up high on the safety pad. It the trampoline users are small and young, or older and heavier, the internal composition of the bladders is almost infinitely adjustable to the intended end user(s) of the trampoline. This increases both the utility and flexibility of the safety system described herein.

And, due to the introduction of multiple internal bladders for the safety bag, it is possible to vary the contents of each smaller bladder to further alter or fine tune performance and response to impacts. For example, some bladders can be filled entirely with air or some other gas, while others can be filled with liquid, all within the same safety bag. Some bladders may be filled with a portion of liquid of any viscosity, while the remainder is filled with air or other gas. If partially filled with a liquid, it is preferable to fill the remaining space with air or gas so that the bladder does not collapse due to insufficient volume. This is important because gravity, weight, mass and the like put a downward force on bladders when stacked one upon the other, singly, FIG. 1C and FIG. 1F, or in bunches and groups, FIG. 10K.

The safety bag, bladder or pad is able to deflect a user's impacts, whether bodily or by appendages like hands, feet, elbows or any other parts of a body. It functions such that upon impact, the pad moves to the left or right to some degree in a manner which helps to deflect a user of the trampoline away from the pole or support member to which the pad is attached. The internal bladders may be configured to alter deflection and impact response as has been previously described. Another means of the current system to provide safety to a user on a trampoline is by affecting deflection of impacts. Deflection is a key function, which is considered only for use within a trampoline system. A bag that can be outside of a trampoline environment need not ever consider deflection as either an issue or concern in the way it is for trampoline use. In a trampoline environment, it becomes a significant safety feature. A trampoline user must continually be protected from unwanted fall-offs and impacts against the enclosure and trampoline structure; which are irrelevant concerns in other environments. Thus, a safety pad occupying a space within an enclosure requires specialized safety considerations and benefits in protecting a user on a trampoline surface when coming into contact with the bag. Deflection from any portion of the enclosure or its support members or poles is vital to the design.

Where a safety bag is suspended between two vertical support members or poles, the bag absorbs impact energy such that an impact transfers energy more broadly and diffuses what would otherwise be a "point impact" into a more distributed and diffused impact. This lowers the likelihood of damage to the enclosure wall, such as enclosure rips or "zipper tears" (like ripping clothing), or known as a "point load rip or tear". Many enclosures are made with tight netting or weaves as opposed to more open netting to supposedly prevent fingers getting caught. The disclosed impact bag minimizes the damage that such types of netting are vulnerable.

Deflection is achieved through several means and in several manners, individually, or in concert. First, the bag is designed to permit a rotation or twisting action when struck. Upon impact from a user it revolves to some degree around the support member helping to redirect an impacting individual or user away from the support member. It helps to laterally redirect an impacting user or individual. This rotation or twist occurs about the vertical axis of the bag, or also of the support member. When the bag is secured such that it contacts the pole or other support member above the trampoline surface, but it is not limited to that. It is beneficial to prevent a user from impacting or contacting such support members or pole during use of the trampoline. The rotation causes the impact to be redirect away from the support member or pole. The rotation may also "corkscrew" such that, as the twist occurs, the bag may rotate lower or higher based upon the force or direction of an impact. This rotation or twist serves to both absorb and redirect an impact away from a support pole which reduces the chance of a user from striking another part of the trampoline or its enclosure. Even if an impact is exactly in line with the support member or pole behind it, the bag still acts as a protective cushion, though its rotation might be very slight; or in rare cases almost nonexistent. When an impact, intentional or otherwise, is off center from the support member or pole, the bag will rotate around the axis of the support pole which redirects the impact force away from that pole. In the case where a pad is suspended between two poles as previously described, the twisting or rotation serves to reduce the impact force against a trampoline net as part of an enclosure. Thus, the pad serves a significant safety function beyond a simple additional barrier to a support pole. For the purposes of this disclosure, the term "pole" includes other types of support members, so long as such support members permit the attachment of the instant safety pad on a trampoline.

Figures 11A, 11B, 11C, 11D:
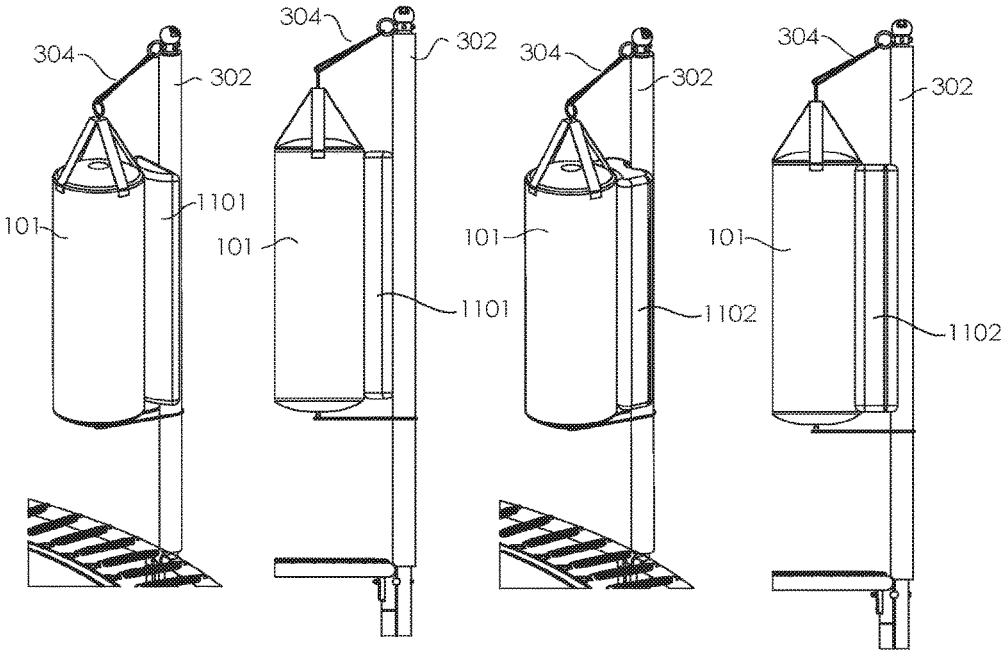
FIG. 11A is an upper view of an impact safety bag attached to a trampoline enclosure pole with a D pad in between them.
FIG. 11B is a side view of an impact safety bag attached to a trampoline enclosure pole with a D pad in between them.
FIG. 11C is an upper view of an impact safety bag attached to a trampoline enclosure pole with a contoured pad in between them.
FIG. 11D is a side view of an impact safety bag attached to a trampoline enclosure pole with a contoured pad in between them.

This beneficial rotation or twisting of an impacted bag can be enhanced by situating a secondary pad against the pole, FIG. 11A. This additional pad's shape is such that it facilitates the redirection of the force of an impact against the bag away from that primary point of impact, and away from a direct impact force against the pole. One shape could be that of a "half round" shape, more flat on one side, and more rounded on the other; or some shape similar thereto. Such shape serves to further enhance the redirection of a user's impact in a direction away from the original direction of the impact and away from the point of that same impact.

In an alternative design, the second pad may also be shaped to adapt to the shape of the first bag, FIG. 11C. In this case, rotation is greatly reduced or removed, but the safety bag still moves within this design, but with far less pendulous motion, which is beneficial in those cases where impacts are more rapid and intentional. Also, the internal configuration of the instant bag, and its shape and mass, continues to provide additional protection from contact with the enclosure and trampoline structure, than would otherwise be available to a user. In the event of an off center strike or impact, this secondary pad will still help prevent the user from unwanted impact with the enclosure support. Finally, although it is not shown in the drawings, one or more secondary pads can be placed adjacent to a net or enclosure barrier when the primary impact safety bag or pad is situated somewhere between to enclosure support members or poles, and at or above the jump surface within the enclosure.

Another aspect of the instant pad or bag design is that it permits a pendulous or oscillating swing motion upon being impacted. The safety pad is connected to the upper portion of the pad and the upper portion of a pole or support member such that an impact to a lower portion of the pad causes it to move to some degree like a pendulum or in a pendulous motion. Pendulous is simply an oscillating, swaying or swinging motion. This serves to both absorb an impact and to redirect its energy away from the impact point. This functionality is enhanced because the bag is attached to the support structure, like a pole or between two poles, from a position higher than the primary mass of the bag. Also, the attachment point on the pad is generally in the upper region of the pad. The pendulous effect occurs even where the pad is connected at a secondary location or locations from the bottom of the bag to another part of the trampoline. Even if the lower connection point is secured tightly, there will still be a slight pendulous effect. Where the lower connection is achieved by a single cord or strap, some rotation is still permitted, which continues the previously described benefit. The lower connection will be achieved via one or more straps, cords or ropes of some kind, or other resilient material that permits either a pendulous or twisting action from the bag upon impact. The benefit is achieved even if the movement of the safety pad is extremely slight due to the "rigidity" or reduced flex or rotation permitted by the lower connection.

As previously stated, the conditions within a trampoline jumping surface and enclosures are utterly unique compared to suspending a bag next to a wall or ground secured barrier. The activity on a trampoline is fluid, three dimensional, where the bouncing of a user can send them in different directions upon each separate impact or jump. Often, the direction of travel of a user is not anticipated, so the need for a properly designed bag for safe use within a trampoline is of paramount importance. Other currently available bags may appear to mirror the external look of some of the bags shown herein, however, none were designed or intended for safe use within an enclosure with a trampoline surface where a user is jumping. Current bags that may be "jury rigged" into an enclosure are not designed for the purpose and are not recommended for that reason. Systems described herein address these unique issues for the trampoline while actually increasing the safety for a user jumping on the trampoline. Thus, both play benefits and safety are increased with the addition of the instant device.

Another safety concern when using an impact bag within a trampoline is that the angle of a body when suspended above the trampoline surface at the apex of a jump (where no body part is in contact with the jump surface) may rotate or twist in any manner possible in a three dimensional movement. In short, one cannot simply hang an additional bag as part of an enclosure and ignore these unique and additional safety issues associated with a fluid jumping action by one or more users on a trampoline.

Another issue of concern is that the majority of trampolines situate their jump surfaces above the ground level or floor surface. This elevation, while common and convenient, can increase the possibility that a strong enough impact against an enclosure barrier or barrier support structures, could result in the trampoline structure tilting in the direction of the impact location and direction. A tilting structure is unwanted as it increases the risk of the entire structure falling over, or tilting enough that it interferes with a user's safe actions while on the trampoline, whether jumping or impacting anything within the enclosure. One could tie or secure such an above ground trampoline system to the ground to reduce a tip-over risk. However, securing a trampoline to the ground surface can interfere with the flex of the superstructure which in turn can increase the stresses placed upon it. A structure that is thus tied down to the ground surface has less ability to "breath" by flexing freely when a jumper is rebounding. Thus, one is making a trade-off where, on the one hand, they reduce a tip over likelihood, but at the same time, on the other hand, reduce the flex and movement of the entire structure, a less preferred condition for an above ground trampoline. Adding ground attachments increases the cost of the device as well. The instant safety pad system removes the need for additional ground connection of an above ground trampoline.

The tipping risk of a trampoline increases with the addition of a safety enclosure, the good purpose of which is to reduce fall-off injuries of jumpers. When a user impacts the wall of an enclosure, the enclosure serves to prevent a fall off injury be stopping the momentum of the impact. The users mass and momentum can direct a substantial amount of energy against the barrier of the enclosure or its support members. The instant device or pad serves to minimize the ability of a trampoline to tilt towards its side in multiple ways, which in turn, increases the safety of the users within the enclosure, as well as outside observers, while still maintaining the safety benefits of the enclosure system itself, while minimizing and reducing the previously described point impacts, rips or zipper tears.

One way this is accomplished is because the bag is weighted above zero lbs., and, when hung from a point or region above the center of mass of the bag, serves to allow the bag to swing when struck. The bag is designed to protect against unintentional impacts, but may also respond effectively to intentional impacts by a user. For example, if a user were to initiate a high karate style kick to the upper portion of the bag, the energy would be dispersed generally, and then the bag would swing and the bottom portion of the bag would hit the enclosure pole, or the body of the net wall when suspended between vertical support members. The rigidity of the bag is more optimally set to facilitate this function by setting it so that the bag moves as one member. The structure of the disclosed internal bladder system facilitates this preferable action. The bottom of the bag will swing into the pole and distribute energy into that lower portion of the pole. This beneficial effect occurs even when the safety pad is impacted while situated somewhere between two supports or poles on an enclosure, where the pad is adjacent or in contact with an enclosure wall or net. The instant device will tend to swing the impact energy downward, which in turn, helps spread the impact along the height of the pole instead of only at the high location of the original impact of the high kick example.

The disclosed pad also helps prevent tipping because the thickness of the bag helps keep a user from getting closer to the outside of the jump surface, and therefore closer to the center of the trampoline. This lowers the risk of point load rips or tears as the energy is transferred more broadly by reducing the point load force of an impact. This results in a longer lifespan for the net or enclosure wall, which in turn, increases the safety during that net wall lifespan. Users or owners can tend to ignore small tears or damage to their enclosures because they don't want to spend the money for a replacement, and they don't recognize the potential severity of the danger. A point load rip can tear open rapidly upon the impact of an unsuspecting user such that a dangerous and unexpected risk may develop very rapidly. Additionally, the internal composition of the bladder system will also serve to absorb impact energy which will reduce the force applied against the enclosure, which in turn, reduces the force that would cause tipping of the structure. This is achieved both by redirection upon impact or contact by reducing the point load and transferring the impact energy more broadly; as well as the unconscious tendency of a jumper to avoid an object adjacent to the enclosure and within it. Users tend to unconsciously avoid objects impinging or encroaching, however slightly, in the space above the trampoline surface. It is simply an amplified example of what occurs via the mere existence of an enclosure wall, which also has this same affect.

When contact occurs against a support member or pole or an enclosure by a user, it is generally unwanted and unintended. Without the bag, the user's mass runs right up to the pole, or into the net. When the mass is further out from the center of the trampoline, it increases the tendency of the trampoline to tip, so this device increases safety by keeping jumpers from getting too far from the center. Finally, the resilient bag absorbs impacts over a longer time than the thinner pole padding, or an unpadded pole. This longer impact time leads to lower peak forces, and reduces the ability for the trampoline to tip. These same lower peak forces will also work where the bag is between vertical poles alone the net wall.

This disclosure relates to any trampoline that may support an enclosure or some kind of attached pole as previously described. The disclosed devices are also adaptable to smaller trampolines; though not shown in the drawings with the instant device. Such smaller trampolines are generally less than 4 feet in diameter and are more geared to children or smaller users. The safety pad described would need to be size adapted to function with a smaller trampoline, with a proportionally smaller size and dimensions. It will more commonly be used with trampolines at or greater than 4 feet in diameter. Such trampolines have a bed that is made of flexible fabric attached in any manner to an encompassing frame directly or indirectly by spring elements and will be higher off the ground surface; generally, between 24 inches to 40 inches. Additionally, these trampolines may have one of any polygonal or non-polygonal shapes, which may also utilize the benefit of the current devices described herein. Also, it is common for such trampolines to be capable of supporting a safety enclosure. The described system will all function with a trampoline installed in the ground, so long as support members are available for supporting the safety pad.

Embodiments described herein are for trampolines greater in size. But, for trampolines under 5 feet, it becomes necessary to factor encroachment of a safety pad as a percentage of the usable jump surface and the space above it. A smaller trampoline that utilizes an enclosure can seem like jumping in an old style phone booth, or other narrow space. In such situations, the user is less "jumping around" and more often jumping up and down with footfalls landing near the same location on the jump surface. In such cases, the utility of a safety pad is less necessary when enclosure impacts are reduced.

The frames generally define a central opening that supports a flat or planar rebounding mat or jumping surface that is elastically suspended within the central opening. The trampoline surface is generally coupled to any type of spring elements that can permit at least some level of rebounding movement when a user is on it. The frame can be of several configurations and is not limited by shape in any dimension beyond its need to support a flat rebounding surface at any angle.

The adult and adult sized users of such devices are individual persons generally over 16 years old, and between a height of 4 feet 7 inches and 6 feet 7 inches, with a weight range between 70 lbs to 500 lbs, though generally, the common user will fall within the range of normal weights of the general population. Children between the ages of 4 to 8 may also use these trampolines for fitness and fun, but their bodyweight is generally lighter, between 30 to 80 lbs. Young people between the ages of 8 and 16 can vary greatly in weight and size, from 50 lbs to in excess of 400 lbs. Systems described herein are configurable to support each of individuals in these weight ranges and within these age groups. Additionally, these trampolines may have one of any polygonal or non-polygonal shapes, which may also utilize the benefit of the current devices described herein.

The instant safety pad may double as an impact bag, which increases the protection provided a user while on a trampoline. In addition, the type employed is specifically employed to provide additional safety for a user by absorbing the energy of impacts that may occur against the enclosure and supporting poles.

One or more of the instant safety pads may be coupled to a vertical enclosure pole of a trampoline. Also disclosed is a method of coupling these bags to a multi directional swivel and pivoting crank mechanism and its components attached to a vertical enclosure pole, of a trampoline. This permits a user to adjust the placement of the bag in different hanging locations, side to side, up and down, and front and back.

FIG. 1A shows a bladder filled impact safety bag comprised of the bag 101, hanging straps 102, a top connector 103, and a top flap 104. The top flap 104 can be opened to fill the bag 101.

Figure 1B:
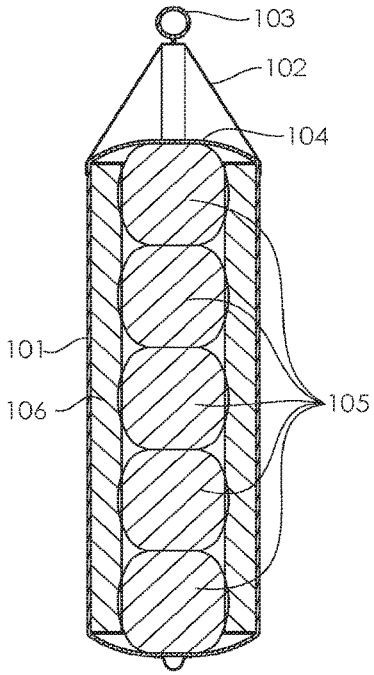
FIG. 1B is a cross section side view of a sphere bladder filled impact safety bag.

FIG. 1B is a cross section view of a bladder filled impact safety bag. The bag is filled with multiple internal bladders 105 and they may be surrounded with a layer of foam or other space filling barrier 106. These bladders 105 can be weighted with liquid or other filler, to give the bag its weight. Typical impact bags are stuffed with fabric scraps and sand, and as a result are bulky and expensive to ship. Such bags are not suitable for installation on a trampoline due to the unique demands of the environment and the lack of any consideration of these conditions when such bags were designed and fabricated. This new impact safety bag design allows the bladders, 105, and impact safety bag, 101, to be flattened, so the product can ship in a compact and lightweight package. Once received, the end user can fill the bladders, 105, with a liquid or other filler to achieve the desired weight for the assembled impact safety bag.

Figure 1C:
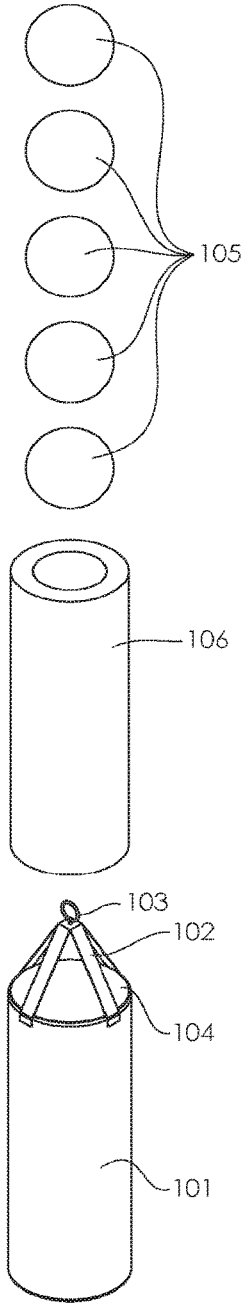
FIG. 1C is an exploded isometric view of a sphere bladder filled impact safety bag.

FIG. 1C is an exploded view showing the foam type liner, 106, and multiple bladders, 105, which are inserted into the top opening, 104, of the impact safety bag, 101. This embodiment shows five bladders, 105, but any number can be used. There are an optimal number of bladders to load depending on the size of the bag, 101. In this case, if only 1 to 3 bladders were to be installed on a bag that would require more based upon its size and height, 105, the solid, gas, or liquid filler would not be evenly spaced out throughout the bag and there would be a more noticeable lumpiness to the impact safety bag. If too many bladders are installed into a bag, while perhaps serving to more substantially fill in additional space between the bladders, is not a preferable trade off as it will provide a user little in the way of a noticeable difference in response; and filling becomes more difficult and unnecessarily costly by adding unneeded bladders.

Figure 1D:
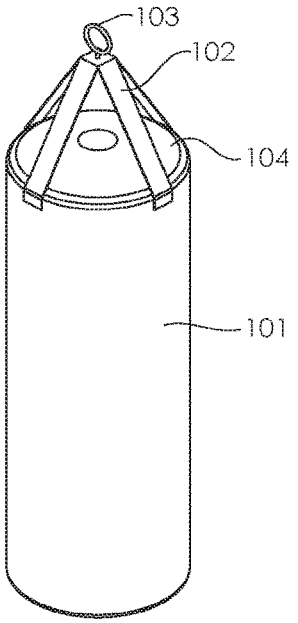
FIG. 1D is an isometric view of a disc bladder filled impact safety bag.
Figure 1E:
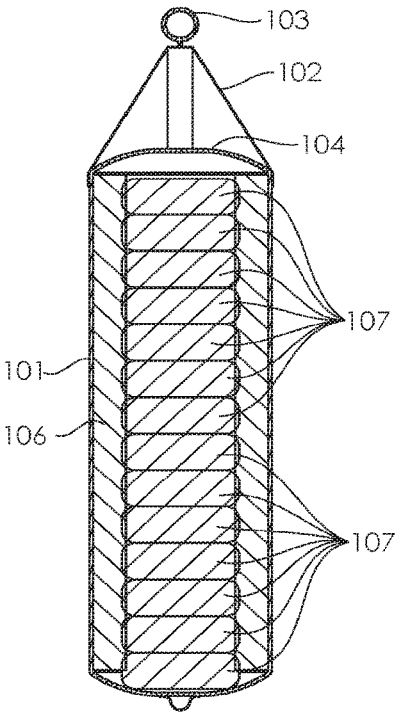
FIG. 1E is a cross section side view of a disc bladder filled impact safety bag.
Figure 1F:
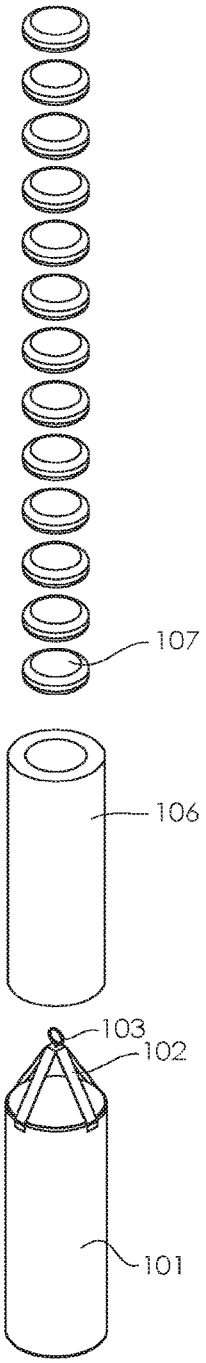
FIG. 1F is an exploded isometric view of a disc bladder filled impact safety bag.

FIG. 1D shows a bladder filled safety pad comprised of the bag, 101, hanging straps, 102, a top connector, 103, and a top flap, 104. The top flap, 104 can be opened to fill the bag, 101. FIG. 1E is a cross section that shows the bag, 101, filled with disc shaped bladders, 107, instead of the round ones. This shape results in more of the volume filled with the bladders. This embodiment shows a number of relatively thin discs, 107, to provide a fine degree of weight adjustment. Fewer discs, 107, can be used if they are thicker to fill the bag, 101. FIG. 1D shows a bladder filled safety pad comprised of the bag, 101, hanging straps, 102, a top connector, 103, and a top flap, 104. The top flap, 104 can be opened to fill the bag, 101. FIG. 1E is a cross section that shows the bag, 101, filled with disc shaped bladders, 107. This shape results in more of the volume of the safety pad being filled with the bladders. This embodiment shows a number of relatively thin discs, 107, to provide a fine degree of weight adjustment. Fewer discs, 107, can be used if they are thicker to fill the bag, 101. FIG. 1F is an exploded view showing disc shaped bladders, 107, that are inserted into the foam layer, 106, removed from the external bag, 101.

Figure 2A:
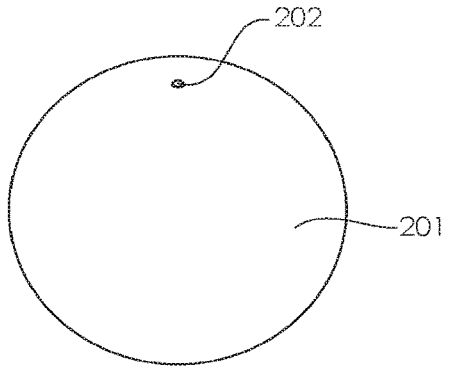
FIG. 2A is an isometric view of an impact safety bag bladder.
Figure 2B:
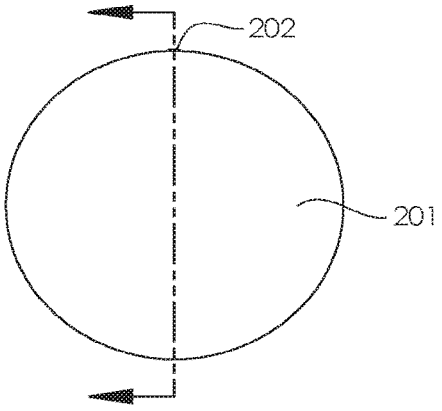
FIG. 2B is a front view of an impact safety bag bladder.
Figure 2C:
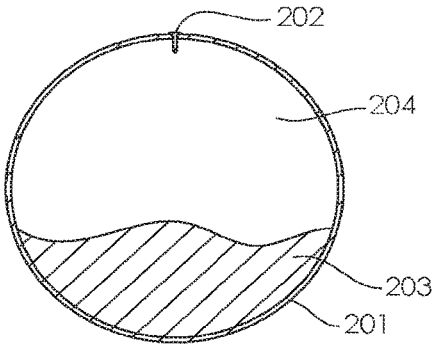
FIG. 2C is a side cross section view of an impact safety bag bladder that is ⅓ full of liquid.
Figure 2D:
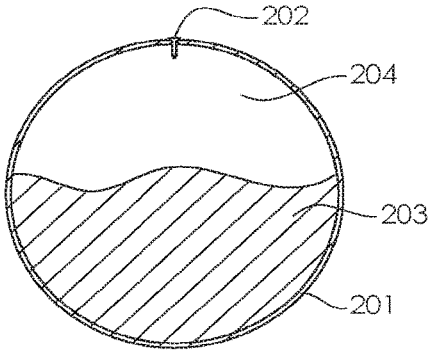
FIG. 2D is a side cross section view of an impact safety bag bladder that is ⅔ full of liquid.
Figure 2E:
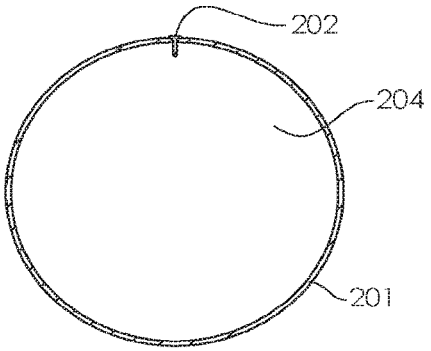
FIG. 2E is a side cross section view of an impact safety bag bladder that has no liquid.

FIG. 2A shows a bladder, 201, that has a sealing plug, 202. FIG. 2B is a front view of a safety pad bladder that has a sealing plug, 202. FIG. 2C is a cross section view of a bladder, 201, partially filled with filler or liquid, 203. The rest of the volume is filled with air, 204. The sealing plug, 202, can be removed and installed repeatedly if the user wants to change the amount of filler or liquid, 203, in the bladder, 201. Other types of fill valves can be used, such as a pin valve found on basketballs. For that a needle adapter would be provided which threads onto a hose or sink so liquid can be injected into the bladder. A thread on cap could also be incorporated into the bladder, 201, which would provide a large fill hole for easy water or other liquid filling. FIG. 2D shows a bladder, 201, that is around ⅔rds full of liquid, 201. FIG. 2E shows a bladder, 201, that has no liquid and is completely filled with a gas or air, 204. This system allows for an impact safety bag with customizable weight and stiffness. Other bags that are designed for punching are common in boxing gyms and the like, but are not designed to protect users in a trampoline environment; and also such devices are extremely dense and can be dangerous for inexperienced boxers to use. Thus the instant safety pads allows for a lightweight and compliant system when the bladders are filled, 201, either with all air, 204, or mostly air, 204, and some liquid, 203, in any proportion. Conversely, this system can still achieve a stiff and heavy feel when the bladders are filled mostly or entirely with a weight increasing filler or liquid, 203. The benefit in this situation is that it is much less costly to ship an empty bag and deflated bladders than it is to ship a fully stuffed weighted bag.

Figure 3A:
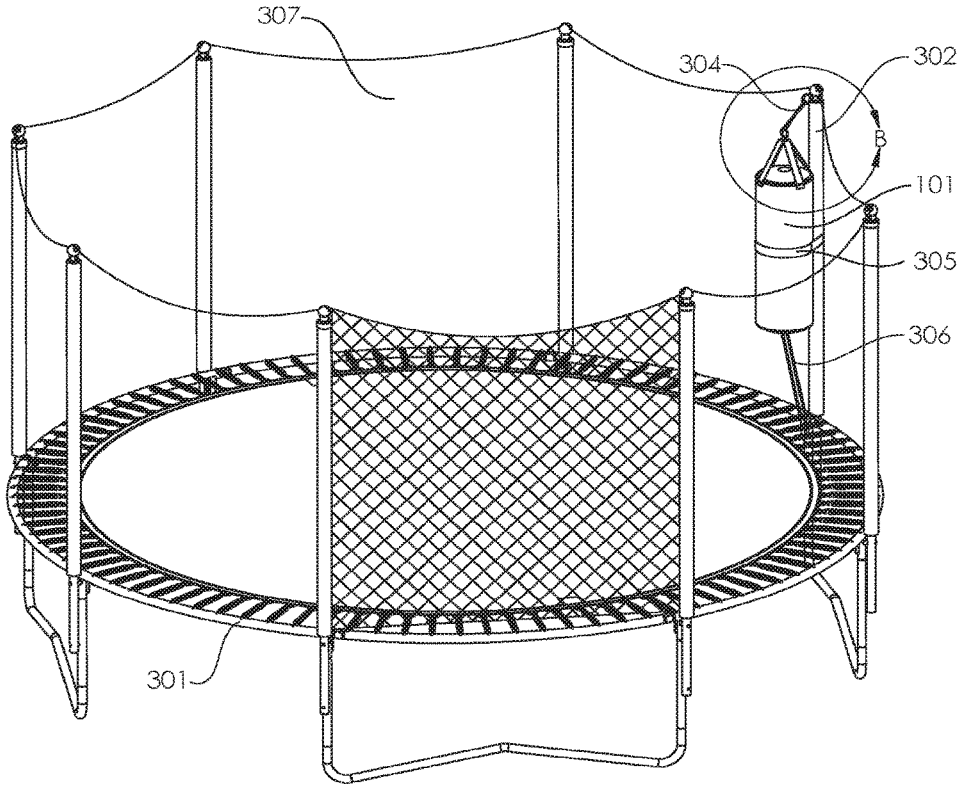
FIG. 3A is an upper view of a trampoline with an impact safety bag installed.

FIG. 3A shows an impact safety bag attached to a backyard trampoline using a linear pole enclosure support system. The illustrated trampoline has a frame that includes a side rail 301 that that is a generally horizontally extending closed loop that defines a central opening and that is connected to the perimeter of the rebounding surface such that the rebounding surface is suspended above the ground. The illustrated side rail 301 defines a circular opening; in other trampolines (not shown) the side rail can define openings of other shapes, such as rectangular or octagonal openings. The system of FIG. 3A has several enclosure poles, 302, the impact safety bag, 101, a top support strap, 304, a middle support strap, 305, a bottom support strap, 306, and a safety enclosure wall or net, 307, that is a supported expanse of flexible material, such as netting or fabric. Enclosure poles, such as the poles, 302, are sometimes referred to herein as vertical support members. The term "vertical" is used to mean that the poles extend above the surface of the rebounding surface, not that the poles need to be perfectly vertical in orientation. In FIG. 3*a*, one expanse of the net, 307, is shown extending between two poles in the foreground. It should be understood that the net extends entirely around the perimeter of the trampoline and forms a generally cylindrical wall that defines a jumping chamber over the illustrated rebounding surface, which is sometimes referred to herein as a jumping mat. Although not shown in some of the other drawing figures for clarity, it should be understood that any of the trampoline systems described herein can have a similar safety enclosure wall. FIG. 3A shows the safety pad, 101, positioned in front of the enclosure pole, 302. The safety pad is advantageously sized to have a cross sectional area at least nine times greater than the cross sectional area of the enclosure poll, 302. This minimum size is to ensure the safety pad, 101, is large enough to shield a person from the enclosure pole, 302.

Figure 3B:
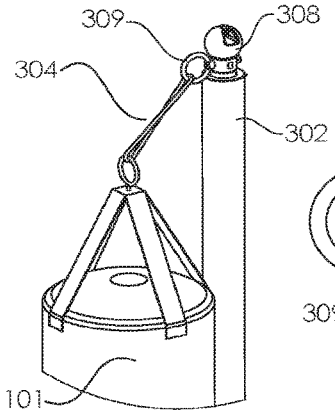
FIG. 3B is a close up upper view of a connection of an impact safety bag to the trampoline enclosure pole.

FIG. 3B shows an eye bolt attachment configuration comprising of an eye bolt, 309, and a receiving enclosure ball end cap, 308. It should be readily apparent that a ball end cap is not required for the instant safety pad be installed. The safety pad may be coupled in any number of manners that are not shown in the drawings. Any coupling method that achieves the result of hanging the instant impact safety pad to the enclosure support member is applicable. For example, the connection can be achieved regardless of how the end of the support member or pole is shaped. Additionally, the instant device could be attached anywhere along the continuum of an inverted U shaped pole where the two end points of the pole, are located at or below the trampoline surface level. Or poles that are connected above the trampoline surface by supports connected upper portions of the support members such that they do not move independently. Such an arched appearing pole or enclosure support may also be adapted to fit the instant safety pad, with the additional benefits flowing therefrom.

Figure 3C:
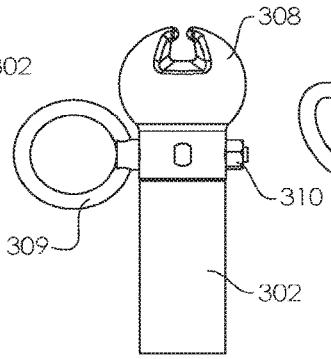
FIG. 3C is a side view of a trampoline enclosure pole configured to attach an impact safety bag using an eye hook.
Figure 3D:
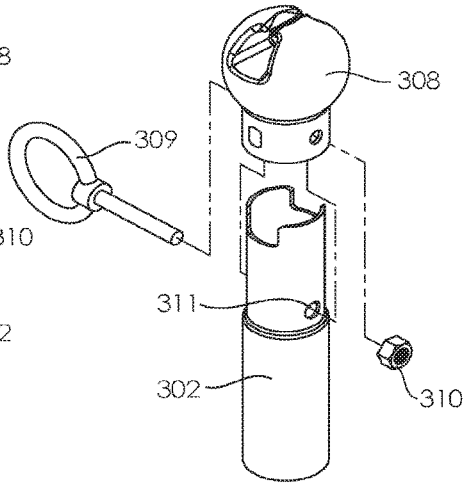
FIG. 3D is an exploded view of a trampoline enclosure pole configured to attach an impact safety bag using an eye hook.

In the example shown, FIG. 3C reveals that the eye bolt, 309, goes through the enclosure pole, 302, and is fastened with a nut, 310, on the other side. FIG. 3D is an exploded view showing how the eye bolt, 309, goes through the ball end cap, 308, enclosure pole through holes, 311, and into the nut, 310. The eye bolt, 309, can either clamp on the ball end cap, 308, or the end cap could be cut away so the eye bolt, 309, seats on the outside of the enclosure pole, 302.

Figure 4A:
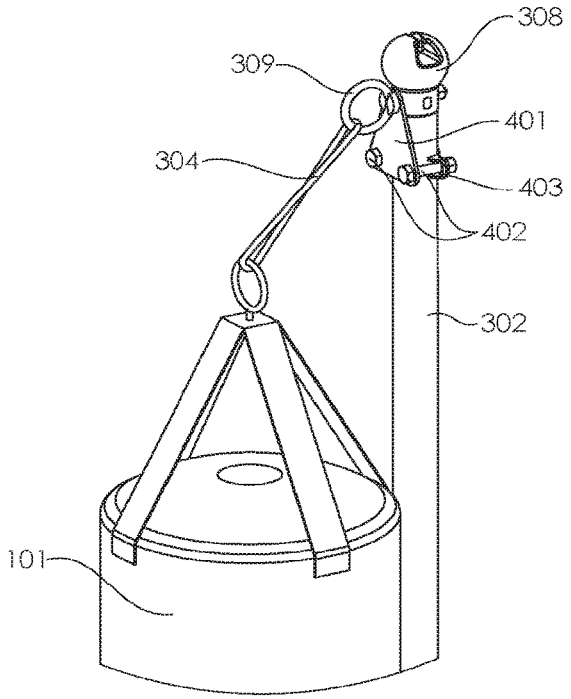
FIG. 4A is a close up upper view of a connection of an impact safety bag to a trampoline enclosure pole with a support plate.
Figure 4B:
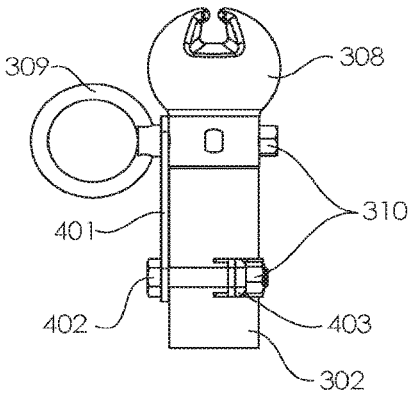
FIG. 4B is a side view of a trampoline enclosure pole configured to attach an impact safety bag using an eye hook with a support plate.
Figure 4C:
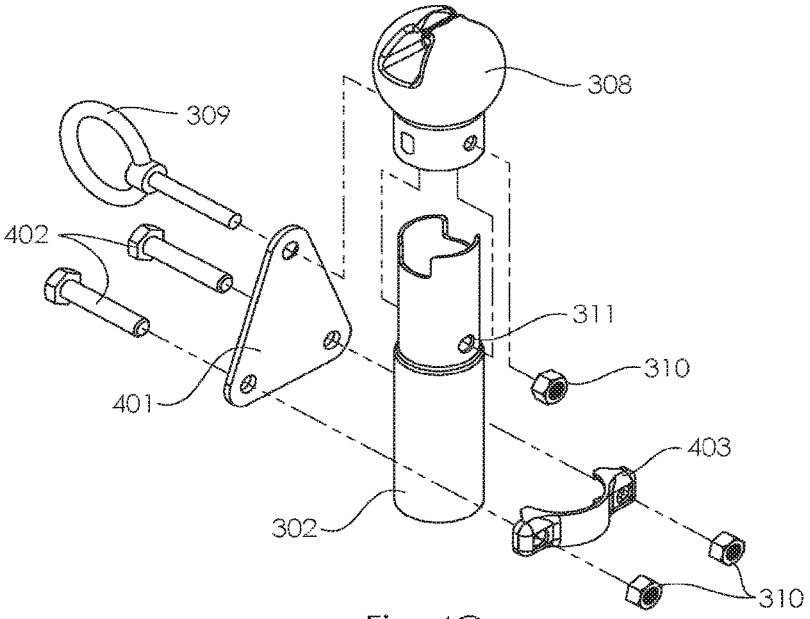
FIG. 4C is an exploded view of a trampoline enclosure pole configured to attach an impact safety bag using an eye hook with a support plate.

FIG. 4A shows an alternate mounting configuration using a plate to spread the load across the enclosure tube. It is comprised of an impact safety bag, 101, a top strap, 304, an eye bolt, 309, an enclosure pole, 302, the enclosure pole ball end cap, 308, a support plate, 401, clamp bolts, 402, and a pole clamp bracket, 403. FIG. 4B is a side view showing the mounting plate, 401, clamped to the enclosure pole, 302. FIG. 4C shows the eye bolt, 309, and the two clamp bolts, 402, clamp down on the support plate, 401. The support bolts, 402, straddle the outside of the enclosure tube, 302, while the eye bolt, 309, goes through the enclosure pole through hole, 311. The pole clamp bracket, 403, provides support for the bolt clamp nuts, 310.

Figure 5A:
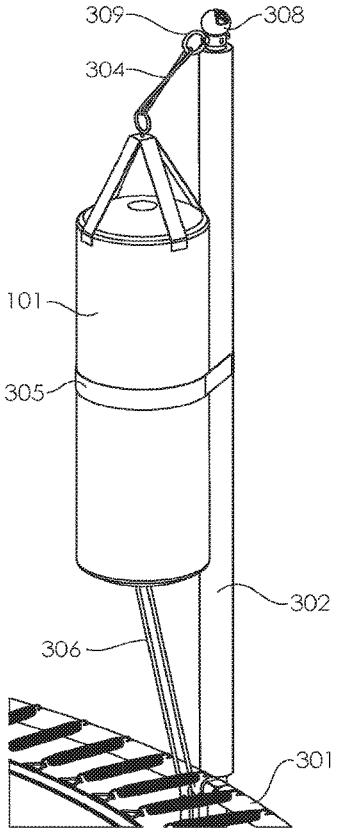
FIG. 5A is a close up upper view of an impact safety bag attached to a trampoline enclosure pole.

FIG. 5A shows how the impact safety bag, 101, is strapped to the enclosure pole, 302, as well as having a connection point at the lower end of the safety bag that is also coupled to a location closer to the trampoline surface. The lower coupling location may vary. It can be at the bottom of the enclosure support member or pole; a frame rail for those trampolines that possess them; to a spring member, whether at or below the jump surface. It is sometimes preferable that the bag, 101, is supported by more than just the top strap, 304, if the bag, 101, exceeds a certain weight for example, or less pendulous action is desired. The center strap, 305, and bottom strap, 306, connects the bag, 101 to the enclosure pole, 302, which prevents it from swinging. When the bag, 101, and pole, 302, are connected, they only have to withstand impact. When the bag, 101, is hanging primarily from the top strap, 304, it is able to pendulously swing which can put considerable additional stress on the enclosure support member or pole, 302. The straps, 304, 305, and 306 can either be rigid for little to no movement, or they can be elastic to allow for some movement. Some movement may be more desirable for a more dynamic interaction, but the elastic straps will still prevent the bag, 101, from swinging out of control.

Figure 5B:
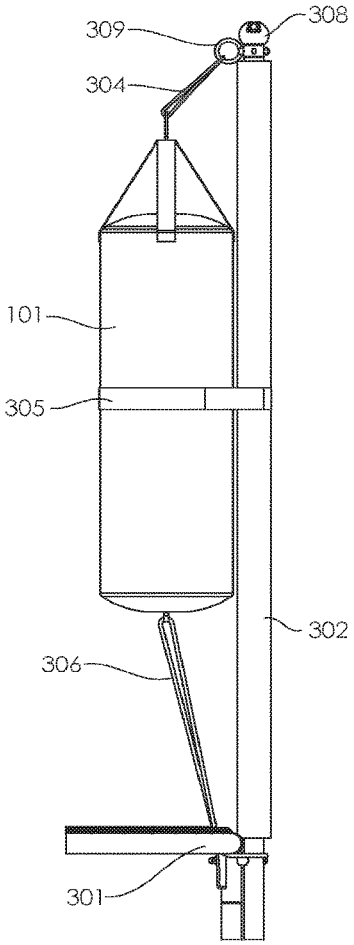
FIG. 5B is a close up side view of an impact safety bag attached to a trampoline enclosure pole.
Figure 5C:
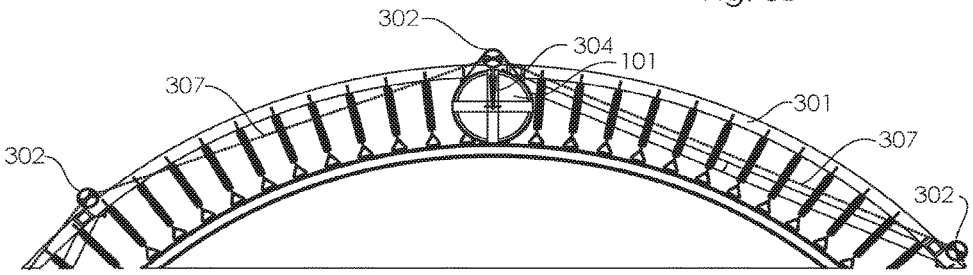
FIG. 5C is a top view showing an impact safety bag attached to a trampoline enclosure pole.

FIG. 5B is a side view showing the safety pad, 101, hanging from the enclosure pole, 302, and attached to the frame, 301, with the bottom strap, 306. FIG. 5C is a top view showing how the cushioned safety bag, 101, shields an enclosure support member, in this case, a pole. 302. The enclosure net, 307, is oriented close in distance to the back of the bag, 101, which forms a barrier around the enclosure poles. This provides safety functionality which increases with the increased length of a bag, 101, to cover more of the pole from a user's impacts, 302, making it very difficult for a jumper to come in contact with a support pole, 302. By having cushioned bags, 101, attached to every pole, 302, the trampoline will have improved safety.

Figure 6A:
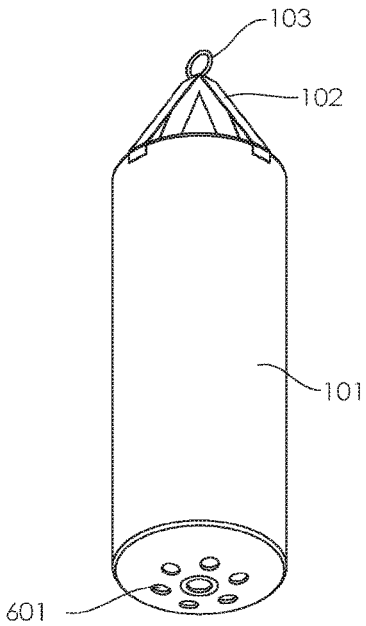
FIG. 6A is a lower isometric view of an impact safety bag with drainage holes.

FIG. 6A shows an impact safety bag, 101, with bottom drainage holes, 601. This feature is useful for outdoor impact safety bags. The drainage holes, 601, allow rain water to freely drain, so no moisture builds up which could cause mold and corrosion. The drainage is also significant for liquid bladder impact safety bags, because the liquid can drain in case the bladder is pierced or leaking. Weather resistant and mold resistant materials may be employed such that an exposed bag and its internals are weather resistant.

Figure 6B:
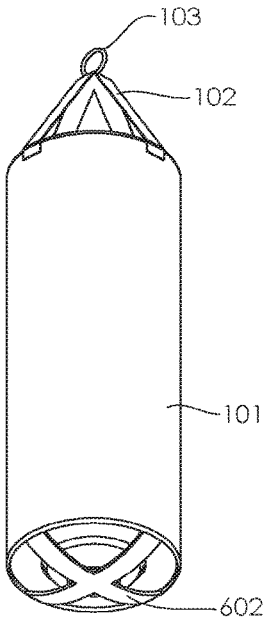
FIG. 6B is a lower isometric view of an impact safety bag with a webbing cross bottom.

FIG. 6B shows an alternate drainage system where there are webbing straps, 602, that hold the impact safety bags, 101, contents. Many trampolines are outside or exposed to an external environment even when covered. Drainage is needed under such conditions. Any number of webbing straps, 602, could be sewn to the bottom depending on how big the holes need to be.

Figure 6C:
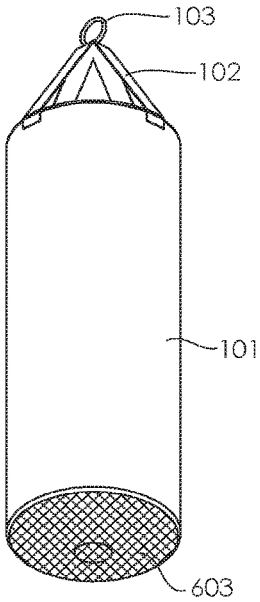
FIG. 6C is a lower isometric view of an impact safety bag with a mesh bottom.

FIG. 6C shows another embodiment for an impact safety bag drainage system. This one has a mesh bottom, 603, which is a strong fabric but allows for liquid to freely flow.

Figure 7A:
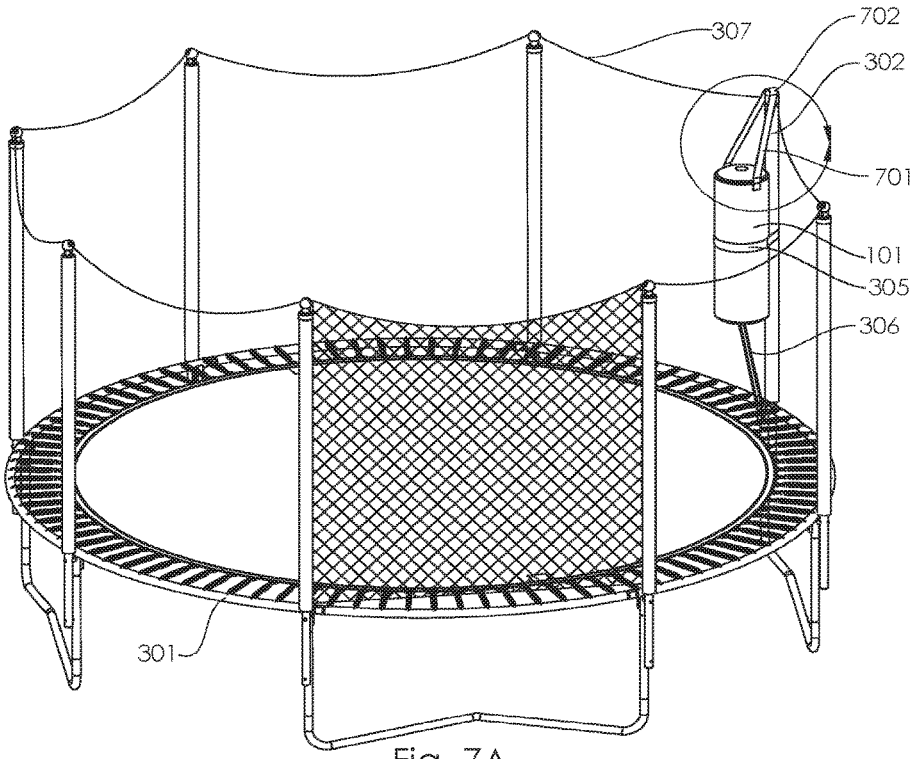
FIG. 7A is an upper view of a trampoline with a fabric hook impact safety bag installed.

FIG. 7A shows an impact safety bag attachment type that is universal for nearly any trampoline design with a safety enclosure.

Figure 7B:
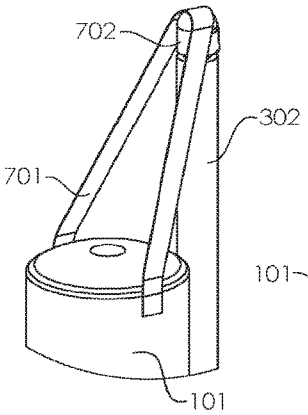
FIG. 7B is a close up upper view of the connection between a fabric hook impact safety bag attached to a trampoline enclosure pole.

FIG. 7B shows the impact safety bag straps, 701, have a pocket style top connector, 702, attached to the end. This is a more universal connecting device in that it may slip over multiple types of pole ends which do not possess a coupling mechanism to attach a bag or suspend a bag from the vertical support pole. It should be appreciated that multiple types of connectors and connections may be envisioned, and the disclosed top connectors are examples of a much larger group of methods of attachment and connection to the vertical pole members, as well as to any horizontal support members that may support the safety bag above the trampoline surface to allow it to function as disclosed.

Figure 7C:
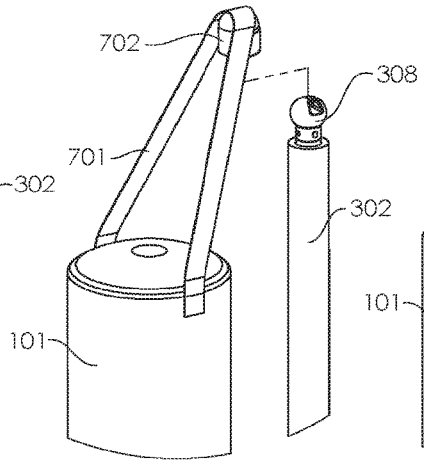
FIG. 7C is a close up exploded upper view of a fabric hook impact safety bag attached to a trampoline enclosure pole.
Figure 7D:
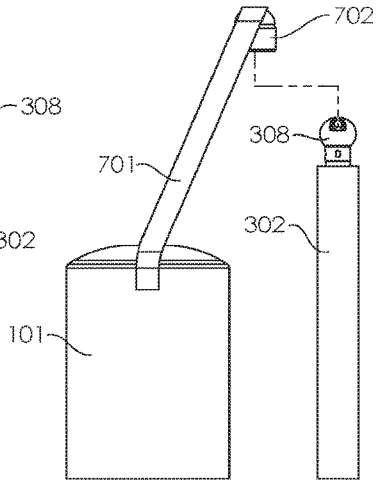
FIG. 7D is a side exploded view of a fabric hook impact safety bag attached to a trampoline enclosure pole.

FIG. 7C shows how the pocket, 702, simply slides over the end of the enclosure pole, 308. This design accommodates a wide range of different size and style end locations of support members and poles, 308. Such a method may be adapted to slip over or otherwise attach to the top end of a support member, and then be tightened or otherwise adjusted to secure the coupling. Velcro straps may be employed to tighten the coupling, or an elastic system could be employed to function like a constricting rubber band might; or other attachment methods may be used. The benefit of such a system is its adaptability to various enclosure systems. This includes adaptation for enclosures with canopies or where the trampoline is a tent like structure or one containing a roof or canopy above the jump surface. FIG. 7D is a side exploded view showing how the pocket, 702, slides over the end of the enclosure pole, 308.

Figure 8A:
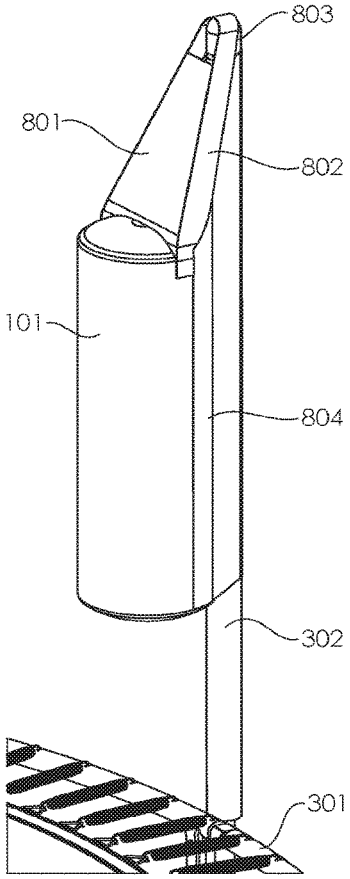
FIG. 8A is an upper view of a fabric enclosed impact safety bag attached to a trampoline enclosure pole.
Figure 8B:
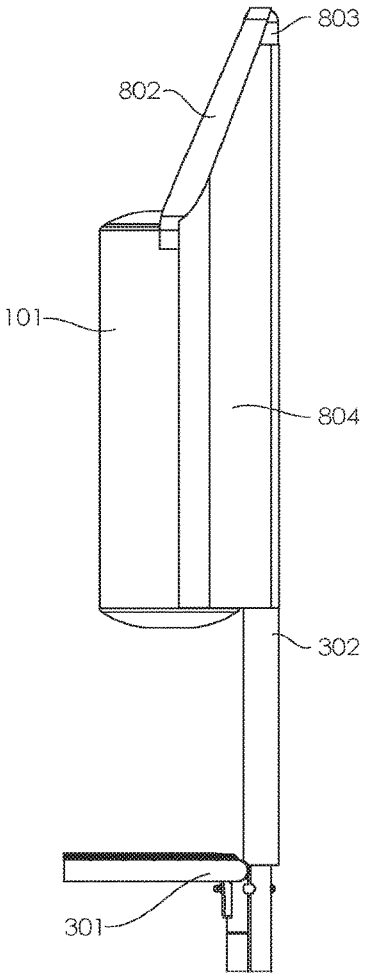
FIG. 8B is a side view of a fabric enclosed impact safety bag attached to a trampoline enclosure pole.
Figure 8C:
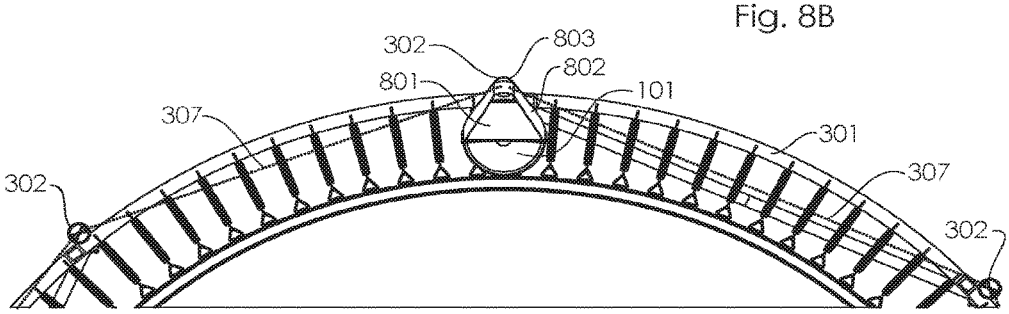
FIG. 8C is a top view of a fabric enclosed impact safety bag attached to a 10 trampoline enclosure pole.

FIG. 8A shows an impact safety bag, 101, attached to a trampoline enclosure pole, 302, that is enclosed in fabric. The front fabric, 801, connects the impact safety bag straps, 801, and the top of the impact safety bag, 101. The side fabric, 804, connects the side of the impact safety bag, 101, and the enclosure pole, 302. This fabric is a safety measure which eliminates all openings where a user's body or extremities could be entrapped or entangled. FIG. 8B is a side view showing the fabric, 804, covering the gap between the rear of the pad, 101, and the enclosure pole, 302. FIG. 8C is a top view showing how the top fabric, 801, connects the straps, 802, and covers the top of the safety pad. This prevents users from getting tangled with the straps, 802, or getting stuck behind the safety pad, 101.

Figure 9A:
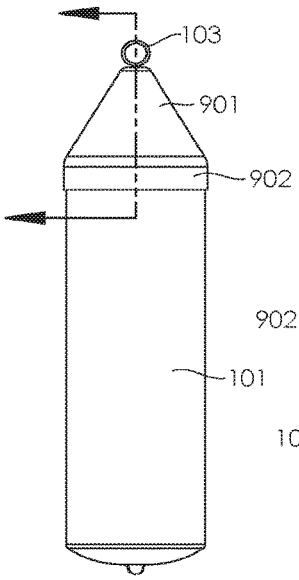
FIG. 9A is a front view of a hooded impact safety bag.
Figure 9B:
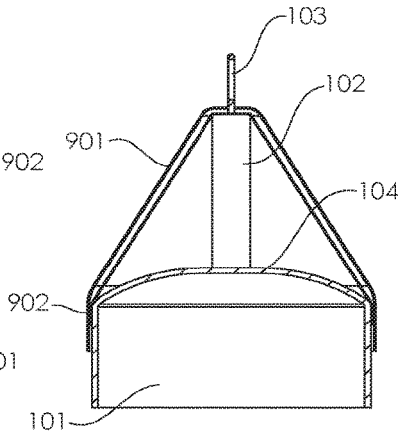
FIG. 9B is a cross section side view of a hooded impact safety bag.
Figure 9C:
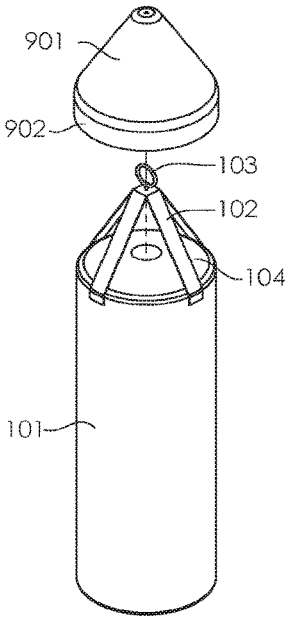
FIG. 9C is an isometric exploded view of a hooded impact safety bag.
Figure 9D:
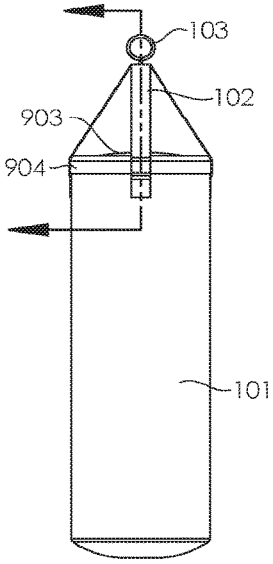
FIG. 9D is a side view of a top flap impact safety bag. 15
Figure 9E:
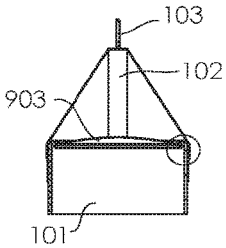
FIG. 9E is a side cross section view of a top flap impact safety bag.
Figure 9F:
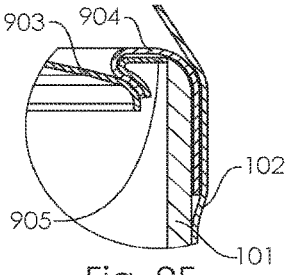
FIG. 9F is a close up side cross section view of a top flap impact safety bag.
Figure 9G:
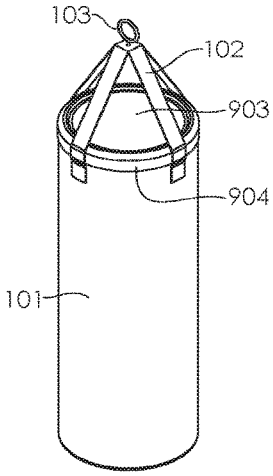
FIG. 9G is an isometric view of a top flap impact safety bag.

FIG. 9A shows an impact safety bag, 101, that has a moisture and sun and weather resistant hood or barrier, 901, covering the straps. The hood, 901, has a flap, 902, which extends down and covers the top seam of the impact safety bag which reduces the intrusion of moisture or sun. FIG. 9B is a side cross section view that shows the hood, 901, covers the hanging straps, 102, and the top of the bag, 104. FIG. 9C is an exploded view showing the waterproof hood, 901, removed from the safety pad, 101. This view shows the exposed straps, 102. The hood, 901, is installed to ensure the straps, 102, are covered to prevent users from getting tangled in them. FIG. 9D shows an alternate design to keep moisture out of the impact safety bag. It is comprised of a top cover, 903, which has a flap, 904, sewn to its edge. FIG. 9E is a side cross section view of the safety pad with a top cover flap. FIG. 9F shows a how the top is sewn. The top cover, 903, has a flap, 904, and a zipper, 905, sewn to it. The zipper, 905, interfaces with a zipper on the top edge of the impact safety bag, 101. Once the top is zipped on, the flap, 904, folds down and covers the zipper seam. FIG. 9G shows how the flap, 904, covers the top seam of the impact safety bag, 101.

FIG. 10A is a front view of a safety pad, 101, that contains concentric bladders. FIG. 10B is a side cross section which shows an impact safety bag, 101, made up of concentric chambers. The concentric bladders may be filled with liquid, air or combination, or made of foam like material. FIG. 10B is a side cross section which shows a safety pad, 101, filled with a fluid bladder made up of concentric chambers. FIG. 10C is a top cross section view showing the chambers filled with liquid as an example, 1001, 1002, 1003, and 1004. The thickness of each chamber decreases the farther it is from the center chamber, 1001, so that each chamber holds an equal volume of liquid. This system allows an adjustable weight impact safety bag while maintaining a consistent feel along the entire height of the bag. For a light weight and soft feel, the user can fill the center chamber, 1001, with liquid, and the outside chambers with air. For a light weight and harder feel, the user can fill the outside chamber, 1004, with liquid and the inside chambers with air. More chambers can be filled with liquid or other filler to increase the weight. The bladder could be made with any number of chambers depending on how much adjustability is desired.

FIG. 10D is a front view of a safety pad, 101, that contains a internally sectioned bladders. FIG. 10E is a side cross section view which shows an impact safety bag, 101, filled with bladders made up of internal lengthwise chambers, 1006, and an exterior air chamber, 1005. FIG. 10F is a top cross section view showing the internal chambers, 1006, and the exterior air chamber, 1005. The internal chambers, 1006, are filled with liquid one at a time until a desired weight or impact characteristic is achieved. After a chosen number of chambers, 1006, are filled with liquid entirely so the weight is even along the height of the bag, the remaining chambers can be filled with air or other medium or solid filler to top off or fill the space such that they do not collapse. The exterior air chamber, 1005, provides a transition to the internal chambers, 1006. This gives the bag a consistent feel even if only some of the internal chambers, 1006, are filled with a liquid. In some cases, not all of the internal bladders will be filled with any medium but rather remain empty. In this case, the bag is otherwise structurally supported such that a collapsed interior bladder does not result in a collapsing condition of the safety bag itself. This could be accomplished in several manners. One could be an internal support system composed of an internal framing of structural supportive material (plastic, foam, air filled struts or supports or the like), while still providing internal space for receiving various bladders. Or, the external wall of the pad could be filled entirely with a gas or air which provides rigidity sufficient to offset any collapse of internal bladders, or when the bag is partially unfilled with those bladders.

FIG. 10G is a front view of a safety pad, 101, filled with vertical tubular bladders. FIG. 10H is a side cross section view which shows an impact safety bag, 101, filled with a bladder made up of cylindrical chambers, 1007. FIG. 101 is a top cross section view showing the cylinder chambers, 1007. Any number of the chambers, 1007, can be filled with a weigh increasing filler liquid to achieve the desired weight, and the remaining space, 1008, can be pressurized with air to fill the space in between the chambers.

FIG. 10J is a front view of a safety pad, 101, filled with balls. FIG. 10K is a side cross section view which shows an impact safety bag, 101, filled with filler sphere bladders, 1009. The filler bladders, 1009, are filled with materials of various densities, such as filler (small pellets of a solid material of various densities as just one example) or liquid, air, or sand, or other material. The different weight bladders, 1009, can be evenly mixed in the bag, 101, to achieve different total bag weights.

Figure 10L:
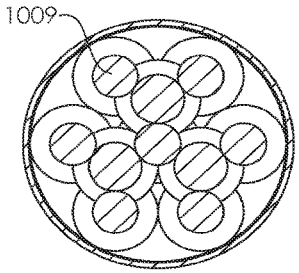
FIG. 10L is a top cross section view of a sphere bladder filled impact safety bag.

FIG. 10L is a top cross section view showing how the filler bladders, 1009, back in the bag, 101. The bladders, 1009, are cheap and easy to replace. If these internal bladders settle or compress after a period of use, then more spheres or bladders, 1009, can be added to refill the bag to offset the compression, so that the top portion of the bag is not collapsed.

FIG. 11A shows a "D" shaped pad, 1101, in between a punching bag, 101, and a trampoline enclosure pole, 302. The pad, 1101, provides additional protection preventing impacts with the pole, 302. It ensures that the pole, 302, is still covered even when the bag, 101, rotates to the side. FIG. 11B is a side view of a contact safety bag, 101, attached to an enclosure pole, 302, with a D shaped pad, 1101, in between them. FIG. 11C shows an alternate contoured shape pad, 1101, in between a punching bag, 101, and a trampoline enclosure pole, 302. This contoured pad, 1102, is shaped to fit the curve of the pole, 302, on one side, and a contour to fit the bag, 101, on the other side. FIG. 11D is a side view of a contact safety bag, 101, attached to an enclosure pole, 302, with a contoured pad, 1102, in between them.

Figure 11E:
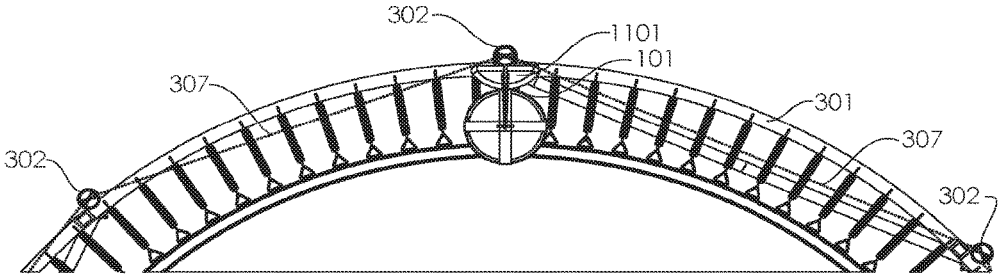
FIG. 11E is a top view of an impact safety bag attached to a trampoline enclosure pole with a D pad in between them.

FIG. 11E is a top view showing a "D" shaped pad, 1101, in between a bag, 101, and an enclosure pole, 302. This shows how the pad, 1101, fills in the space between the bag, 101, and the net, 307. If a user intentionally (or unintentionally) impacts the bag, 101, but misses severely to the side or if they come in from a side angle, the extra pad, 1101, will block the pole, 302. The pad, 1101, fills the space between the bag, 101, pole, 302, and net, 307, so the user cannot slip their foot, hand, or other body part past the bag, 101, and in contact with the pole, 302.

Figure 11F:
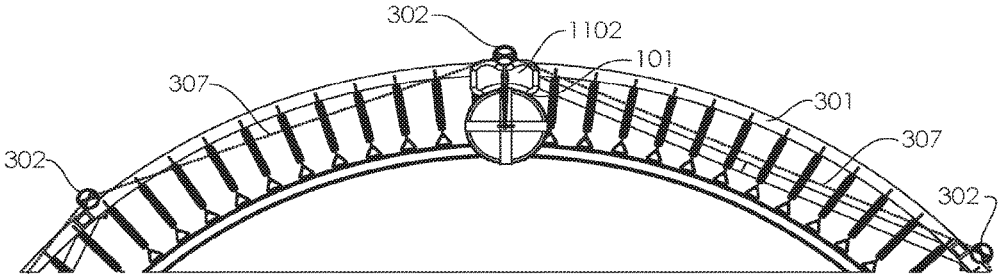
FIG. 11F is a top view of an impact safety bag attached to a trampoline enclosure pole with a contoured pad in between them.

FIG. 11F is a top view showing the contoured pad, 1102, installed. This pad, 1102, fills in more of the space to ensure the pole, 302, is well protected. This option is available to users that want the safety pad to swing less for those cases where the pendulous motion is less desired; usually in cases of more intentional and more rapid impacts. All of the other additional safety benefits of the pad remain, as well as the additional protection from contact with the trampoline frame or enclosure.

Figure 12A:
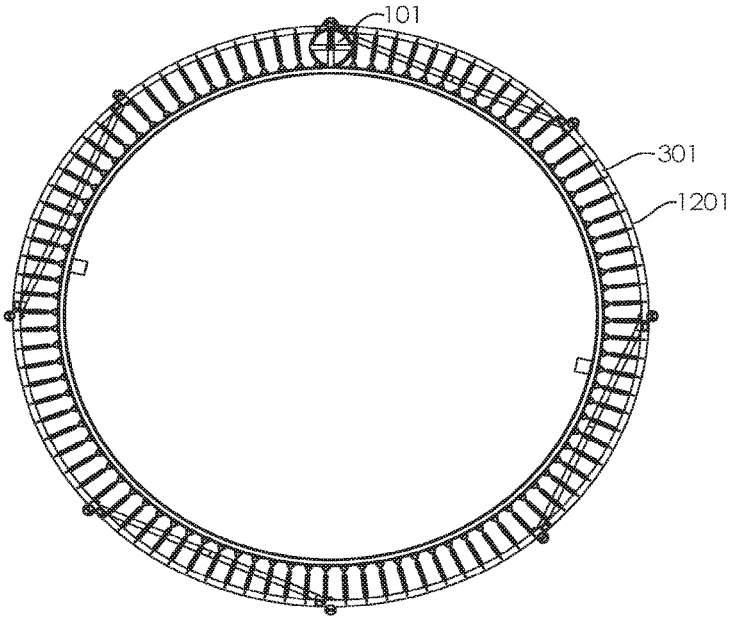
FIG. 12A is a top view of a contact safety pad attached to a trampoline.

FIG. 12A shows a contact safety pad, 101, attached to a trampoline, 301. The outside perimeter of the trampoline frame rail is shown as 1201.

Figure 12B:
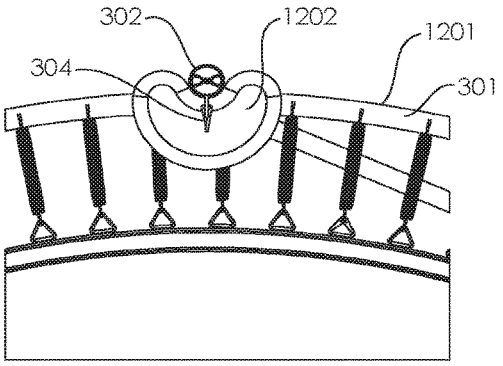
FIG. 12B is a top view of a contoured contact safety pad attached to an enclosure pole.
Figure 12C:
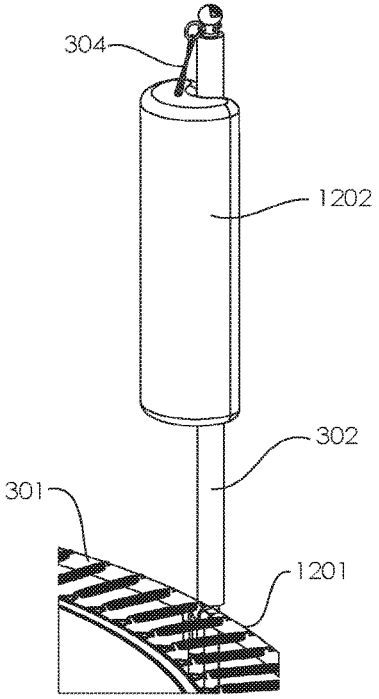
FIG. 12C is a top view showing a contoured contact safety pad that attaches to an enclosure pole with a strap.

FIG. 12B is a top view showing a contoured contact safety pad, 1202, that attaches to the enclosure pole, 302, with a strap, 304. The contoured contact safety pad, 1202, wraps around the enclosure pole, 302, and partially extends past the outside perimeter of the trampoline, 1201. The perimeter of the trampoline, 1201, is defined as the outside diameter of the frame. In this embodiment, 83% of the volume of the safety pad lies within the perimeter of the trampoline, 1201, and 17% of the volume extends past the perimeter, 1201. For the pad, 1202, to be useful and to provide minimal best protection to an impacting user, at least 50% of the volume of the bag needs to lie within the perimeter of the trampoline, 1201. This is because more of the pad volume of material needs to be in front of the enclosure pole, 302, so it can absorb any impacts, and so the user has the minimum safe coverage for protection. Advantageous results have been achieved when 70% to 80% of the pad is within the perimeter rail of the trampoline frame supporting the jumping surface, as viewed from the top. FIG. 12C is an isometric view showing a contoured contact safety pad, 1202, that attaches to the enclosure pole, 302, with a strap, 304. Another way to describe this is to say (for this version and the others shown herein) that at least 50% of the volume of the pad is located inwardly of the frame perimeter of the trampoline as viewed from above.

Figure 13A:
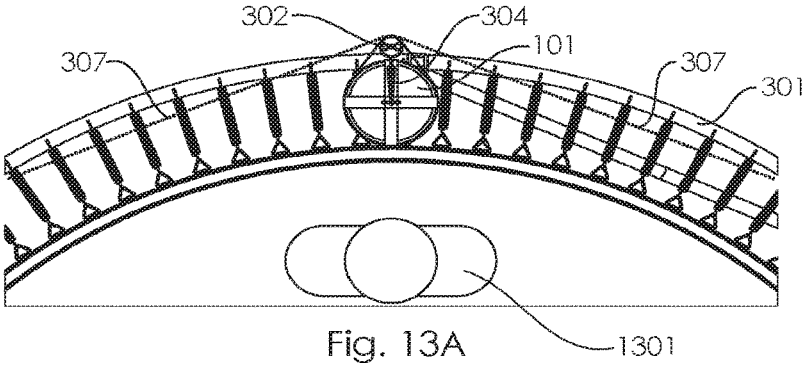
FIG. 13A is a top view of a person facing a safety pad mounted to a pole.

FIG. 13A shows the person, 1301, approaching the contact safety pad, 101. The safety pad, 101, is positioned in front of the enclosure pole, 302, to protect the user, 1301, from the pole, 302.

Figure 13B:
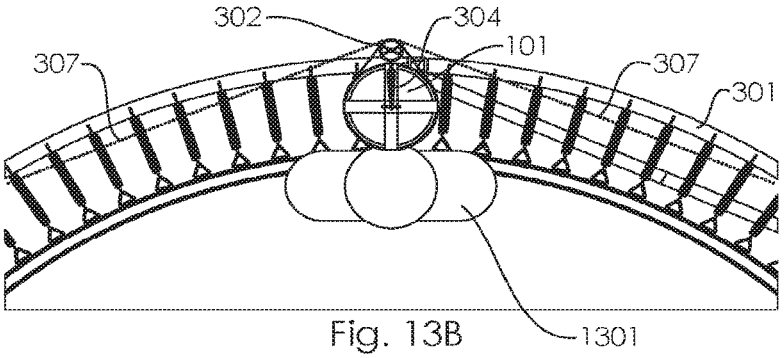
FIG. 13B is a top view of a person impacting a safety pad mounted to a pole.
Figure 13C:
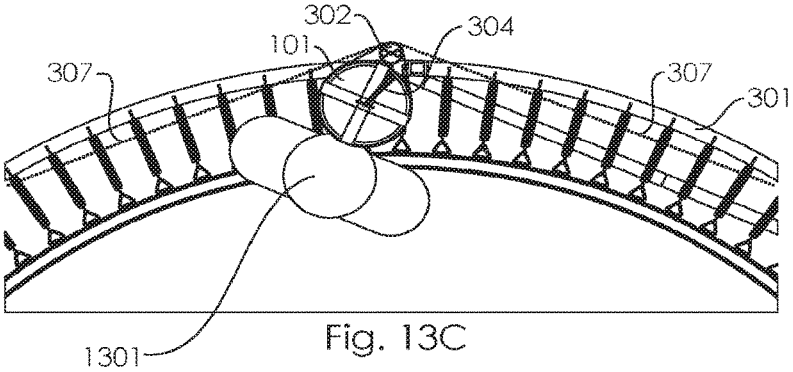
FIG. 13C is a top view of a person being redirected or rotated around a pole when impacting the pole mounted safety pad.
Figure 13D:
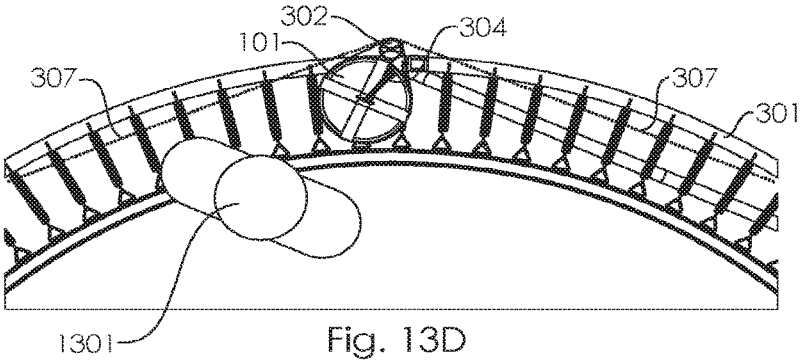
FIG. 13D is a top view of a user being redirected away from an impact with a pole.
Figure 14A:
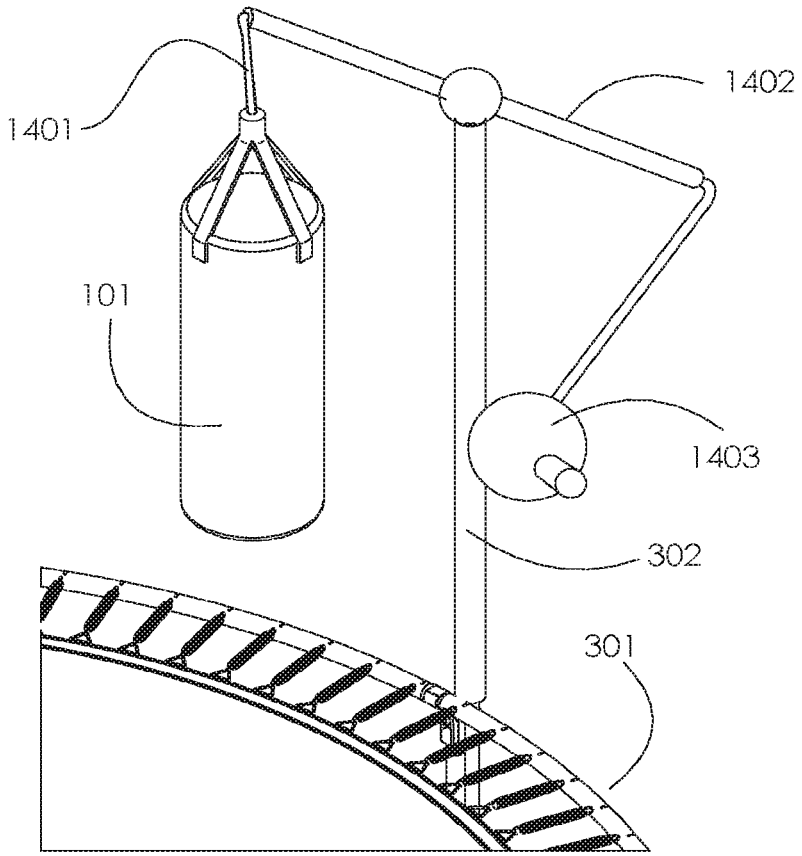
FIG. 14A an isometric view of a safety bag coupled to a multi directional swivel and pivoting crank mechanism and its components attached to a vertical enclosure pole of a trampoline.

FIG. 13B shows the person, 1301, impacting the contact safety pad, 101. The pad, 101, is compliant and starts absorbing energy from the person, 1301. FIG. 13C shows the contact safety pad, 101, and person, 1301, rotating around the enclosure pole, 302. The contact safety pad, 101, is attached to the pole, 302, with a strap, 304, such that it is free to rotate about the pole, 302. If the contact safety pad, 101, is impacted at all off center, it will rotate around the enclosure pole, 302. This is advantageous because it redirects the person, 1301, away from the enclosure pole, 302. FIG. 13D shows after the impact with the safety pad, 101, the user, 1301 is rebounded away, from the enclosure pole, 302. Depending on the impact angle, the person, 1301, will either be redirected back onto the jumping surface, or safely into the enclosure net. FIG. 14A shows a safety bag, 101, is attached, 1401, to a pivot-able crank mechanism and arm, 1402 and 1403, so that the bag may swivel up and down or away or toward the center of the trampoline jumping mat. A wire or cord may run through the mechanism (not shown) to facilitate such operability. The pivot mechanism is attached at some place along the pole, 302 (shown at the top in FIG. 14A), which is attached to the trampoline, 301.

Figure 14B:
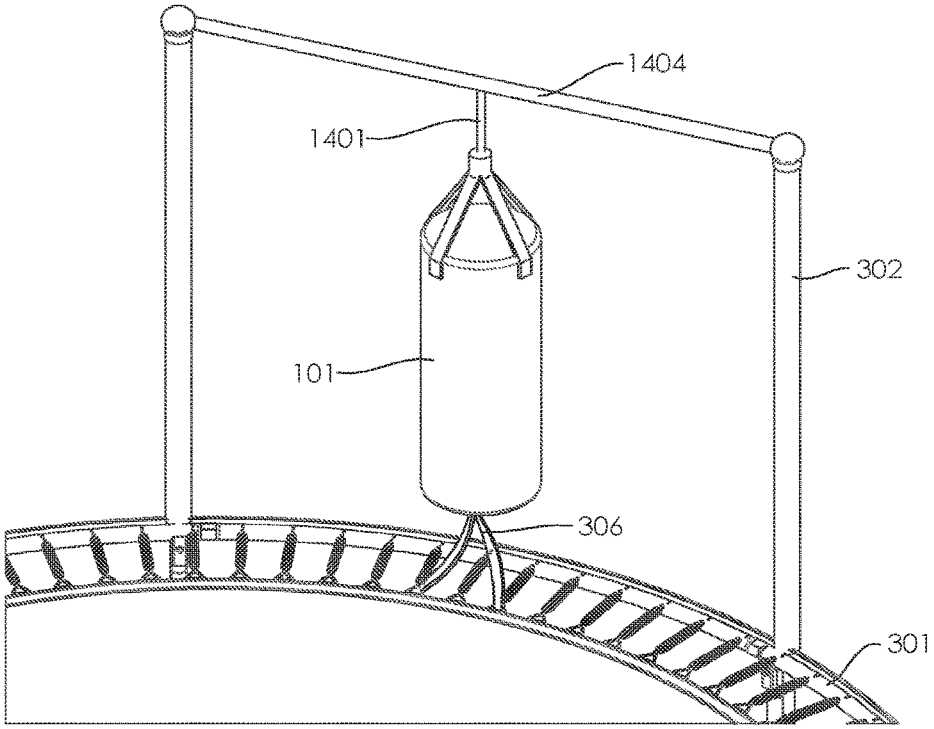
FIG. 14B shows a safety bag suspended between two vertical support members.

FIG. 14B shows an alternative bag support structure where a horizontal tube or rod, 1404, is deployed between two vertical support members or enclosure poles, 302. Each pole, 302, has a connection point, which is located at the top of each vertical support member in the illustrated system. The ends of the horizontal tube or rod, 1404, are connected to the vertical support members at the connection points. The bag, 101, is attached at a central point of the horizontal pole, 1404, by a connective cable or strap, 1401, that extends from an upper portion of the bag. The lower portion of the bag is secured on or near the jumping mat by one or more additional cables or straps, 306. This configuration still permits the bag to provide additional energy absorption if and when any type of impact occurs against the enclosure net. Members such as the tube or rod, 1404, is sometimes referred to herein as a horizontal support member. The term "horizontal" is used to mean that the member extends from one vertical support member to another, not that the horizontal support member needs to be perfectly horizontal in orientation. FIG. 14B shows a horizontal support member, 1404, that is rigid. But a horizontal support member need not be rigid and instead could be made of a material that bends downwardly to some degree under the weight of the bag 101. The horizontal support member needs only be sufficiently rigid to support at least a portion of the bag above the rebounding surface.

Figure 14C:
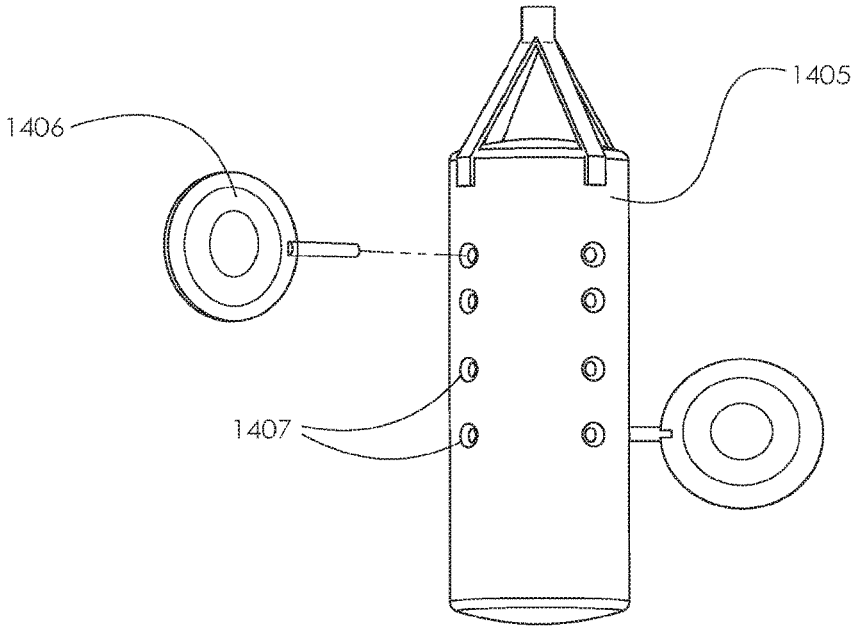
FIG. 14C shows a bag with insertable extensions for additional impact surfaces extending from the bag.

FIG. 14C shows an exploded side view of one of many possible configurations for insertable extensions being able to be coupled to the bag, 1405, in some fashion. The extensions, 1406, may be of various shapes, including but not limited to, faces, animals, pictures painted or otherwise employed on the extension surface, targets, or other game attachments. Insertable holes, 1407, may be deployed on one or more locations anywhere on the bag circumference, high or low, in order to provide maximum adaptability to the type and location of any target device or extension protruding from the bag.

Figure 15:
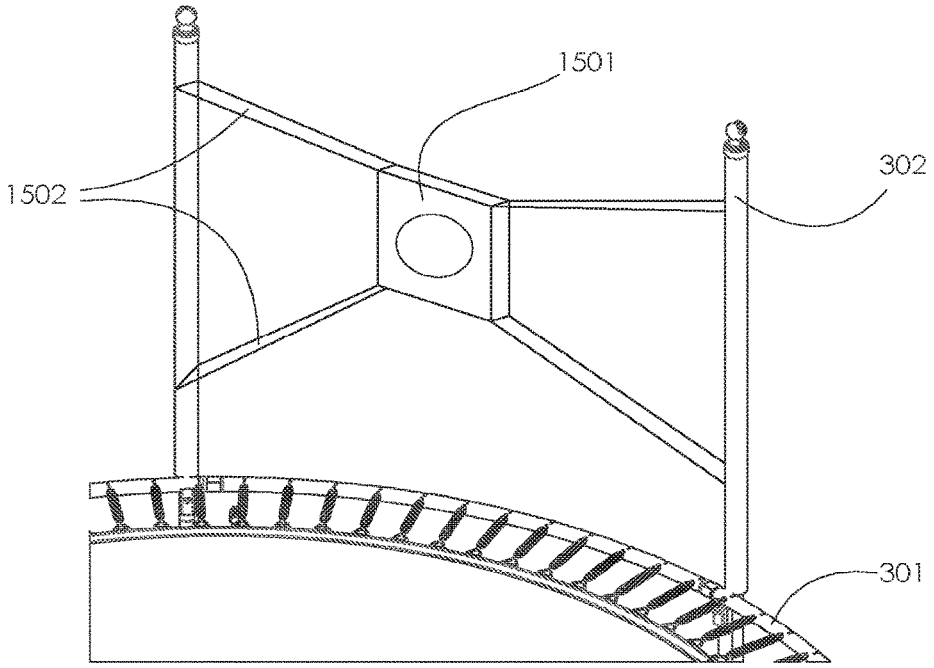
FIG. 15 shows an alternative design where a bag is suspended between two vertical support members without being coupled to the top of the poles.

FIG. 15 shows a target system integrated into the safety design of the enclosure as an improved or additional means of absorbing impacts against the enclosure of a trampoline that employs such an enclosure. The diameters of these larger trampolines, 301, are generally at least 5 feet. A target, 1501, is deployed between two enclosure poles, 302, by coupling members, 1502. The coupling members, 1502, can be straps or cords; or they can be of a rigid or semi-rigid form capable of supporting the safety target, 1501, between a trampoline's, 301, enclosure poles, 302, which are used to support a net (not shown). The safety target, 1501, may be connected to the net without the need of the enclosure poles, not shown, or in combination with both the net, not shown, and the poles, 302. Although not shown, the net is of a type shown in U.S. Pat. No. 6,053,845, issued on Apr. 25, 2000.

Figure 16:
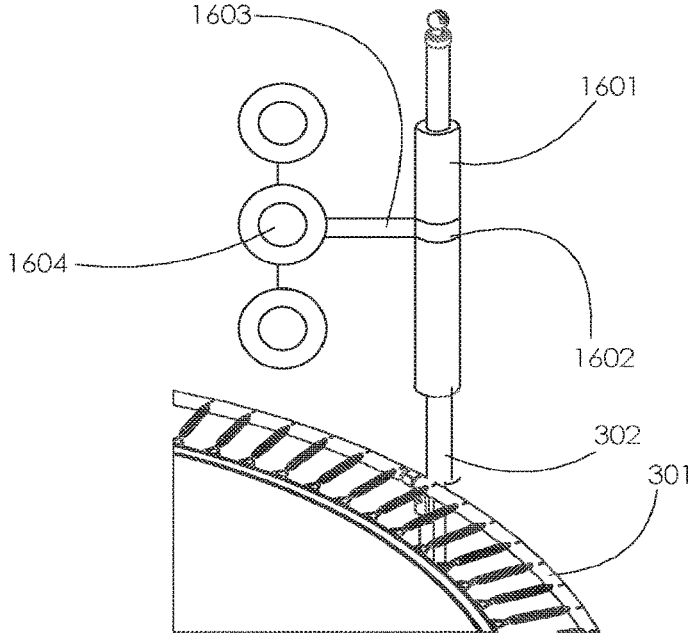
FIG. 16 shows an alternative device designed to receive intentional impacts only.

FIG. 16 shows an enclosure pole target system for use in a trampoline that employs such an enclosure. The diameters of these larger trampolines, 301, are generally at least 5 feet. A targeting component, 1604, is coupled to an enclosure pole, 302, somewhere along its vertical length. The connection to the pole may include a band of soft material, 1602, that surrounds the pole and/or its padding by any number of means. The pole itself will generally have padding as well, so the target is configured to attach to it, or it may serve as the primary padding of the pole itself. 1602 could be a strap that could employ Velcro, or some other method of adhering to the pole sufficient to secure the device. The pole is coupled to the trampoline, 301, so that the targeting component's attachment is secure. The targeting component will generally be of a soft, impact absorbing material, so that it may be more safely employed within a trampoline jump area. The targeting component may have one or more extensions, 1603 and 1604 that may also branch out in multiple directions. For example, some extension may extend much like a person's arm might while waving with their hand above their elbow, thus creating an extension with a 90 degree turn. Other extensions may protrude diagonally, downward or upward, and may also have additional targets attached of various shapes and sizes.

Figure 17:
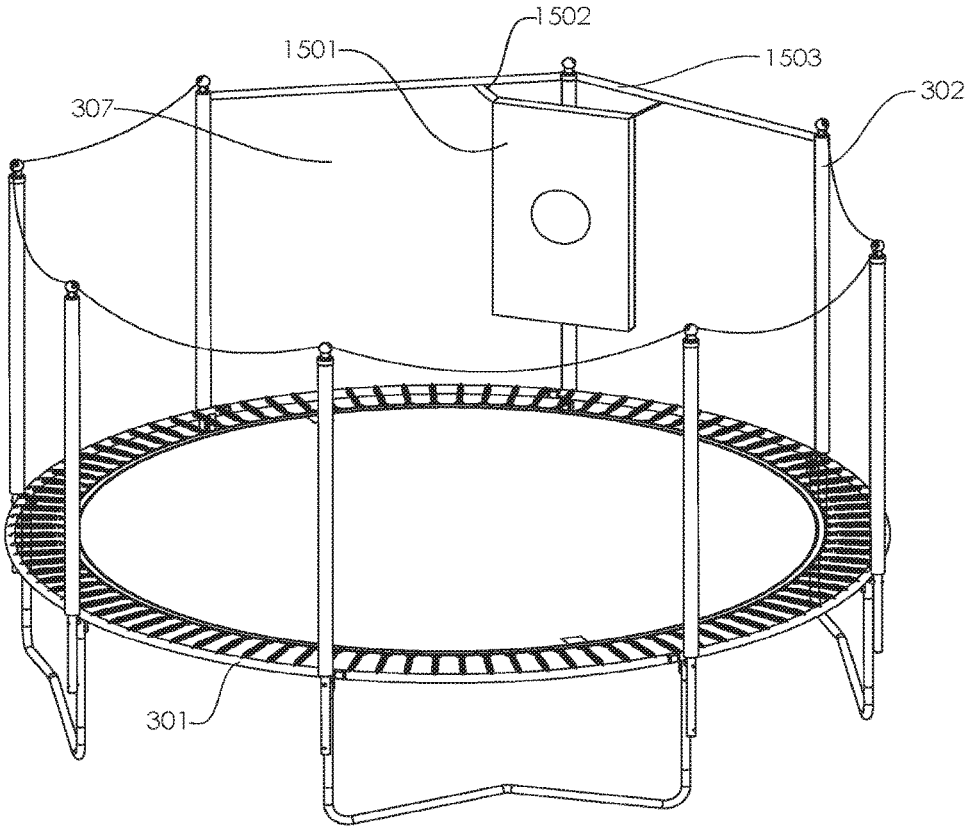
FIG. 17 shows an alternative safety pad attached to the top of the net wall covering a vertical pole.

FIG. 17 shows a trampoline, 301, with an alternatively shaped safety pad, 1501, covering an enclosure pole 302. This embodiment shows rigid or semi rigid supports, 1503, spanning between enclosure poles, 302. The safety pad, 1501, is attached to these supports, 1503, by connecting members, 1502. The connecting members could be webbing straps, rope, wires, elastic straps, or even semi rigid hooks or other type of attachment. Additionally, the top support members, 1503, may be rigid tubular members horizontally disposed. Although not shown, it is evident that such members, 1503, may be added between the other top portions of the vertical pole members such that they are encompass the entire perimeter of the enclosure wall.

While inventions have been described in connection with preferred embodiments, that description is not intended to limit the scope of the inventions to the particular forms set forth, but on the contrary, it is intended to cover such alternatives, modifications, and equivalents as may be within the spirit and scope of the inventions as defined by the appended claims.

The invention claimed is:

1. A trampoline system comprising:

a rebounding surface having a perimeter;

a frame having a rail that is a closed loop that defines a central opening and that is connected to the perimeter of the rebounding surface such that the rebounding surface is suspended above a ground surface;

a support member that is attached to the frame and that extends to an elevation above the rebounding surface; and a safety pad that is attached to the support member, that is rotatable about a longitudinal axis of the support member, that is at least 2 feet in height, that has a volume, and that is at least 3 times wider than the support member, the safety pad being positioned such that at least 50% of the volume of the safety pad is located inwardly of the frame rail as viewed from above, and being configured such that, upon impact by a user, the safety pad partially revolves around the support member and laterally redirects the user.

2. The trampoline system according to claim 1, wherein the safety pad is positioned such that 100% of the volume of the safety pad is located inwardly of the support member.

3. A trampoline system comprising:

a trampoline including a rebounding surface supported by a frame;

a support member that is attached to the trampoline and that extends to an elevation above the rebounding surface; and a safety pad attached to and suspended adjacent to the support member, the safety pad rotatable about a longitudinal axis of the support member, and the safety pad being configured such that, when a user of the trampoline is projected toward the support member, the user impacts the safety pad whereupon the safety pad rotates and/or moves laterally relative to the support member in a manner that helps to deflect the user of the trampoline away from the support member.

4. The trampoline system according to claim 3, wherein the system further comprises:

plural support members that are attached to the trampoline and that extend above the rebounding surface; and an expanse of flexible material that is supported by the plural support members, that defines a chamber above the rebounding mat, and that is positioned to serve as a barrier to prevent the user of the trampoline from falling off the rebounding mat.

5. The trampoline system according to claim 4, wherein:

the safety pad is at least 2 feet in height and has a volume;

at least a portion of the safety pad is at least 3 times wider than the support member measured horizontally;

the chamber has a center; and the safety pad is configured to be positioned such that at least 50% of the volume of the safety pad is located in an area between the support member and the center of the chamber and such that, upon impact by the user, the safety pad partially revolves around the support member and laterally redirects the user toward a portion of the expanse of flexible material that extends between two of the plural support members.

6. The trampoline system according to claim 5, wherein the safety pad is positioned such that 100% of the volume of the safety pad is located in the area between the support member and the center of the chamber.

7. A trampoline system comprising:

a trampoline including a rebounding surface supported by a frame;

a support member that is attached to the trampoline and that extends to an elevation above the rebounding surface, a safety pad attached to the support member, the safety pad rotatable about a longitudinal axis of the support member, and the safety pad being configured to be suspended at a position such that, when a user of the trampoline is projected toward the support member, the user impacts the safety pad whereupon the safety pad rotates and/or moves laterally relative to the support member in a manner that helps to deflect the user of the trampoline away from the support member; and a suspension system connected between an upper portion of the safety pad and the support member, the suspension system being configured to suspend the safety pad in such a position that an impact to a lower portion of the safety pad causes the safety pad to swing like a pendulum.

8. The trampoline system according to claim 3, further comprising a tether system connected between a lower portion of the safety pad and the support member or the trampoline, the tether system being configured to limit swinging of the safety pad.

9. The trampoline system of claim 3, wherein:

the safety pad has a generally cylindrical outer surface portion;

the generally cylindrical outer surface portion has an axis; and the safety pad is suspended to rotate about the axis of the generally cylindrical outer surface portion.

10. The trampoline system according to claim 9, further comprising a supplemental pad located between the safety pad and the support member to further protect the user from impact with the support member.

11. The trampoline system according to claim 9, further comprising a supplemental pad located between the safety pad and the support member, the supplement pad having a curved surface facing the safety pad, the curved surface being configured to urge the safety pad to rotate when the user impacts the safety pad.

12. The trampoline system according to claim 3, wherein the safety pad is a bag that contains a resilient material or one or plural resilient members.

13. The trampoline system according to claim 12, wherein the bag contains one or plural gas-tight bladders containing gas, one or plural liquid-tight bladders containing a liquid, or a combination thereof.

14. The trampoline system according to claim 3, further comprising a suspension system comprising plural straps connected between an upper portion of the safety pad and the support member.

15. The trampoline system according to claim 14, further comprising a tether system connected between a lower portion of the safety pad and the support member or the trampoline.

16. The trampoline system of claim 3, wherein the safety pad has a generally cylindrical outer surface portion.

17. The trampoline system according to claim 16, further comprising a supplemental pad located between the safety pad and the support member.

18. The trampoline system according to claim 17, wherein the safety pad is a bag that contains a resilient material or one or plural resilient members.

19. The trampoline system according to claim 18, wherein the bag contains one or plural gas-tight bladders containing gas, one or plural liquid-tight bladders containing a liquid, or a combination thereof.

20. The trampoline system according to claim 19, further comprising:

straps that extend upwardly from the safety pad; and a hood positioned over the straps to cover the straps.

21. The trampoline system according to claim 20, further comprising at least one ring located between the straps and the support member.

22. The trampoline system according to claim 3, wherein the safety pad is of unitary construction or comprises multiple segments.

23. The trampoline system according to claim 3, wherein:

the portion of the support member that extends above the rebounding surface has a height; and the safety pad is at least one half the height of the portion of the support member that extends above the rebounding surface.

24. The trampoline system according to claim 3, wherein the safety pad is configured such that, upon impact by the user, the safety pad moves to the left or the right in a manner which helps to deflect the user of the trampoline away from the support member.

25. A trampoline system comprising:

a rebounding surface that has a perimeter;

a frame having a rail that is a closed loop that defines a central opening and that is connected to the perimeter of the rebounding surface such that the rebounding surface is suspended above a ground surface;

plural vertically extending support members that extend to an elevation above the rebounding surface, including a first vertically extending support member having a connection point located at or below the elevation above the rebounding surface and a second vertically extending support member having a connection point located at or below the elevation above the rebounding surface; a horizontal support member that extends between the first and second vertically extending support members and that is connected to the first and second vertically extending support members at the respective connection points;

a wall that comprises an expanse of flexible material that is coupled to the plural vertically extending support members and arranged to define a jumping chamber; and a safety pad that is attached to the horizontal support member and that has a volume, the safety pad being positioned at the perimeter of the rebounding surface as viewed from above such that at least 50% of the volume of the safety pad is located inwardly of the frame rail as viewed from above, and being configured such that, upon impact by a user, the safety pad laterally redirects the user to prevent impact by the user against the wall or one of the plural vertically extending support members.

26. The trampoline system of claim 25, wherein the safety pad is entirely contained within the jumping chamber defined by the wall.

* * * * *